US010175591B2

(12) United States Patent
Maeda et al.

(10) Patent No.: US 10,175,591 B2
(45) Date of Patent: Jan. 8, 2019

(54) ELECTROPHOTOGRAPHIC PHOTORECEPTOR

(71) Applicant: Konica Minolta, Inc., Tokyo (JP)

(72) Inventors: Seisuke Maeda, Hussa (JP); Kazunori Kurimoto, Chofu (JP); Kazuhiro Kuramochi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/819,597

(22) Filed: Nov. 21, 2017

(65) Prior Publication Data

US 2018/0143545 A1 May 24, 2018

(30) Foreign Application Priority Data

Nov. 24, 2016 (JP) ..... 2016-228071

(51) Int. Cl.
*G03G 5/147* (2006.01)
*G03G 5/087* (2006.01)
*G03G 15/00* (2006.01)

(52) U.S. Cl.
CPC ..... *G03G 5/14704* (2013.01); *G03G 5/087* (2013.01); *G03G 5/14708* (2013.01); *G03G 5/14726* (2013.01); *G03G 15/75* (2013.01)

(58) Field of Classification Search
CPC ..... G03G 5/14704; G03G 5/14726
See application file for complete search history.

(56) References Cited

U.S. PATENT DOCUMENTS

2003/0073015 A1* 4/2003 Tamoto ..... G03G 5/0507 430/66
2006/0199092 A1* 9/2006 Sugino ..... G03G 5/0614 430/66
2015/0099217 A1 4/2015 Hatano et al.
2015/0241803 A1* 8/2015 Ikari ..... G03G 5/14 430/56
2017/0075236 A1* 3/2017 Kurachi ..... G03G 5/0507

FOREIGN PATENT DOCUMENTS

EP 1223472 A2 7/2002
JP H06-295086 A 10/1994
JP 2014186192 A 10/2014
JP 2014199391 A 10/2014
JP 2015099354 A 5/2015

OTHER PUBLICATIONS

Extended European Search Report dated Mar. 16, 2018 from corresponding European Application No. 17202162.8.

* cited by examiner

*Primary Examiner* — Christopher D Rodee
(74) *Attorney, Agent, or Firm* — Lucas & Mercanti, LLP

(57) ABSTRACT

In an electrophotographic photoreceptor, an electric charge generating layer and an electric charge transport layer are laminated on a conductive support body in this order, a layer configuring an outermost surface of the electrophotographic photoreceptor contains composite structure particles in which a core material is inorganic particles, and the inorganic particles are coated with tin oxide doped with aluminum, and an average particle diameter of primary particles of the composite structure particles is 50 nm to 200 nm.

9 Claims, 3 Drawing Sheets

ELECTROPHOTOGRAPHIC PHOTORECEPTOR

Japanese Patent Application No. 2016-228071 filed on Nov. 24, 2016, including description, claims, drawings, and abstract the entire disclosure is incorporated herein by reference in its entirety.

BACKGROUND

Technological Field

The present invention relates to an electrophotographic photoreceptor (hereinafter, simply referred to as a photoreceptor).

Description of the Related Art

A contact charging method (hereinafter, also referred to as a roller charging system) using a roller or the like is used as a charging method of an electrophotographic image forming process. The roller charging system is a charging system which is capable of performing charging at low energy or performing charging homogeneously, compared to a charging system (a scorotron charging system) using a wire or the like and which is widely used.

In the related art, in the case of mounting the roller charging system, it is attempted to make electric characteristics and intensity compatible by allowing an ultraviolet curable resin to react with a reactable electric charge transport agent to be cured, as in JP 2014-199391 A and JP 2015-099354 A.

In a case where it is attempted to make the electric characteristics and the intensity compatible, it is generally considered to add conductive particles (a conductive filler) to an outermost surface layer. In discharge at the time of roller charging, the conductive filler becomes a ground point of the discharge, and thus, can be a degradation portion due to the discharge. In order to reduce the degradation portion at the time of discharge, conductive particles having a low power resistance value and a large particle diameter are added, and thus, it is possible to reduce a discharge degradation portion while ensuring the volume of the conductive particles in the outermost surface layer. By using the conductive particles having a large particle diameter (also referred to as large particle diameter conductive particles), abrasion resistance is obtained, but a dot diameter of a latent image is easily scattered, and thus, it is difficult to obtain a delicate image.

Examples of the outermost surface layer using the large particle diameter conductive particles include the outermost surface layer exemplified in JP 6-295086 A, but the charging system is a scorotron system, and it is possible to improve the abrasion resistance and a memory, but there is no description of the sharpness of the latent image. In addition, similarly, the large particle diameter conductive particles are used in the outermost surface layer in JP 2014-186192 A, but there is no description of the latent image, particularly.

That is, in the technologies described in JP 2014-199391 A, JP 2015-099354 A, JP 6-295086 A, and JP 2014-186192 A, the large particle diameter conductive particles are used in the outermost surface layer, and thus, the abrasion resistance is obtained, but the dot diameter of the latent image is easily scattered, and thus, it is difficult to obtain a delicate image.

SUMMARY

Therefore, an object of the present invention is to provide an electrophotographic photoreceptor which is capable of suppressing discharge degradation at the time of roller charging and of forming an excellent image with excellent abrasion resistance, in the case of mounting a roller charging system.

To achieve the abovementioned object, according to an aspect of the present invention, in an electrophotographic photoreceptor reflecting one aspect of the present invention, an electric charge generating layer and an electric charge transport layer are laminated on a conductive support body in this order, a layer configuring an outermost surface of the electrophotographic photoreceptor contains composite structure particles in which a core material is inorganic particles, and the inorganic particles are coated with tin oxide doped with aluminum, and an average particle diameter of primary particles of the composite structure particles is 50 nm to 200 nm.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention:

FIG. 4A is a sectional view for illustrating an example of an inorganic particle structure which is prepared in the manufacturing process of the composite structure particles, FIG. 4B is a sectional view for illustrating an example of the structure of the composite structure particles in which the inorganic particles of FIG. 4A are coated with tin oxide doped with aluminum, FIG. 4C is a sectional view for illustrating an example of the structure of the composite structure particles in which the composite structure particles of FIG. 4B are subjected to a surface treatment with a surface treatment agent, and FIG. 4D is a sectional view for illustrating an example of the structure of the composite structure particles in which the composite structure particles of FIG. 4C, subjected to the surface treatment with the surface treatment agent are coated with a fluorine resin.

DETAILED DESCRIPTION OF EMBODIMENTS

Hereinafter, one or more embodiments of the present invention will be specifically described with reference to the drawings. However, the scope of the invention is not limited to the disclosed embodiments.

[Image Forming Apparatus]

An image forming apparatus according to an embodiment of the present invention, including: an electrophotographic photoreceptor having the following configuration;

a charger for charging a surface of the electrophotographic photoreceptor;

an exposurer for forming an electrostatic latent image by irradiating the charged surface of the electrophotographic photoreceptor with light;

a developer for forming a toner image by supplying a toner to the electrophotographic photoreceptor on which the electrostatic latent image is formed; and a transferer for transferring the toner image on the surface of the electrophotographic photoreceptor to a recording medium, in which the charger is a charger of a proximity charging system (the roller charging system) for applying a charging voltage in proximity to (including an aspect of being in contact with) the surface of the electrophotographic photoreceptor. Having such a configuration is excellent from the viewpoint of enabling discharge degradation to be suppressed, excellent abrasion resistance to be obtained, and an excellent image to be formed.

In the image forming apparatus according to the embodiment of the present invention, the charger of the proximity charging system (the roller charging system) negatively charging the surface of the electrophotographic photoreceptor is used. The image forming apparatus having such a charger of the proximity charging system (the roller charging system) may have a configuration in which a charging roller, which is the charger, is disposed in contact with the photoreceptor, or a configuration in which the charging roller is disposed in proximity to the photoreceptor.

Figure 1:
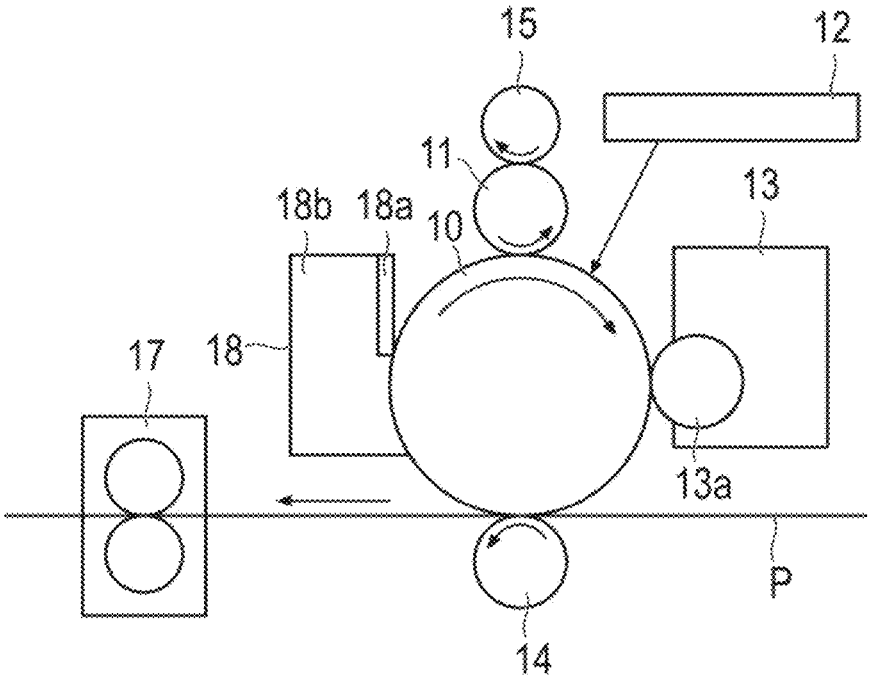
FIG. 1 is a sectional view for illustrating an example of a configuration of an image forming apparatus according to an embodiment of the present invention.

FIG. 1 is a sectional view for illustrating an example of a configuration of an image forming apparatus according to an embodiment of the present invention. In the image forming apparatus illustrated in FIG. 1, the charger of the proximity charging system including a drum-like photoreceptor 10, which is an electrostatic latent image support, a charging roller 11 homogeneously and negatively charging the surface of the photoreceptor 10 by corona discharge having the same polarity as that of a toner, or the like, and a cleaning roller 15 cleaning the charging roller, an exposurer 12 forming an electrostatic latent image on the homogeneously charged surface of the photoreceptor 10 by performing image exposure on the basis of image data according to a polygon mirror or the like, a developer 13 including a developing sleeve 13*a* to be rotated and forming a toner image by transporting the toner retained on the developing sleeve to the surface of the photoreceptor 10 and by developing the electrostatic latent image, a transferer 14 transferring the toner image to a transfer material P as necessary, a fixer 17 fixing the toner image on the transfer material P, and a cleaner 18 including a cleaning blade 18*a* removing a residual toner on the photoreceptor 10 are provided.

[Electrophotographic Photoreceptor]

In the electrophotographic photoreceptor according to the embodiment of the present invention, in which an electric charge generating layer and an electric charge transport layer are laminated on the conductive support body in this order, a layer configuring an outermost surface of the electrophotographic photoreceptor contains composite structure particles in which a core material is inorganic particles, and the inorganic particles are coated with tin oxide doped with aluminum, and an average particle diameter of primary particles of the composite structure particles is 50 nm to 200 nm. According to such a configuration, it is possible to provide a photoreceptor which is capable of suppressing the discharge degradation of the photoreceptor at the time of discharge, of obtaining excellent abrasion resistance, and of forming an excellent image.

In the embodiment of the present invention, it is possible to provide a photoreceptor which is strong for the discharge degradation, has excellent abrasion resistance, and is capable of forming an image having excellent image quality. An expression mechanism or an action mechanism of the reason why such effects are obtained according to the electrophotographic photoreceptor according to the embodiment of the present invention is not obvious, but is assumed as follows.

In the photoreceptor according to the embodiment of the present invention, the outermost surface layer contains the inorganic particles for applying mechanical strength, and it is preferable that the outermost surface layer contains a resin binder (preferably, a polymerized cured substance using a photopolymerization reaction), and the inorganic particles for applying mechanical strength in order to have resistance to discharge. It is necessary that the inorganic particles simultaneously have electric characteristics, and have conductivity. In order to apply conductivity to the inorganic particles, the inorganic particles are contained in an aspect of composite structure particles in which the inorganic particles are used as a core material, and the inorganic particles are coated with tin oxide.

It is considered that having a core-shell structure is preferable for applying conductivity to the inorganic particles described above. Electric charges are contained in the entire particles including the inside of conductive particles, and thus, positive electric charges are not capable of cancelling negative electric charges existing in the conductive particles. For this reason, it is preferable that the negative electric charges exist on surface portions of the conductive particles even in the conductive particles. For this reason, a preferred configuration of the conductive particles is obtained in a case where a core portion has excellent insulating properties to a maximum extent, and conductivity is applied to a shell portion.

In addition, in the outermost surface layer of the photoreceptor containing the particles, in order to maintain the electric characteristics, and to reduce a discharge point, it is possible to reduce a discharge point portion by using particles having a large particle diameter. Here, in this case, the number of discharge points is reduced, and thus, in order to maintain the electric characteristics, it is necessary to decrease power resistance of the conductive particles, and to decrease resistance as the outermost surface layer. However, in the outermost surface layer having such properties, a dot is easily scattered at the time of forming a latent image, and thus, it is not possible to form a delicate image.

In order to solve such problems, it is necessary to adjust volume resistivity of the surface of the inorganic particles having conductivity. It has been found that tin oxide is useful as a material to coat the inorganic particles in order to adjust the volume resistivity, and doping tin oxide with aluminum is useful and adjustable for further adjusting volume resistivity of tin oxide coating the inorganic particles.

Furthermore, as a method of adjusting the resistance (the volume resistivity) with a dopant, the resistance can be adjusted by adding an element having a different valence to tin. In addition, examples of the dopant include antimony, tantalum, or the like, but in the case of doping antimony, there is a case where the formed outermost surface layer becomes bluish black due to the influence of the dopant, and thus, there is a possibility that a coating film having desired transparence is not capable of being formed. It has been found that in order to control a resistance value such that the resistance value is suitable for a photoreceptor surface (the outermost surface layer), it is necessary to increase the resistance of tin oxide, and in order to increase the resistance of tin oxide, tertiary aluminum is suitable. It has also found that antimony is also excellent as the dopant, but antimony is pentavalent, and thus, decrease the resistance of tin oxide, and it is difficult to adjust the resistance for the photoreceptor. In addition, antimony is not suggested from the viewpoint of an environmental load or a cost due to antimony. It has been found that aluminum, which is inexpensive and has handleability, is useful, from the viewpoint of adjustability of the volume resistivity exhibiting the electric characteristics as photoreceptor properties. Thus, it is considered that in the outermost surface layer of the photoreceptor, the inorganic particles of the core material are coated with tin oxide doped with Al, and thus, become the composite structure particles having resistance to discharge, and by containing the particles, it is possible to suppress the discharge degradation at the time of roller charging, to have excellent abrasion resistance, and to form an excellent image. Furthermore, the expression mechanism and the action mechanism described above are merely assumptions, and the present invention is not limited to the expression mechanism and the action mechanism described above.

Hereinafter, the configuration of the electrophotographic photoreceptor according to the embodiment of the present invention will be described.

Figure 2:
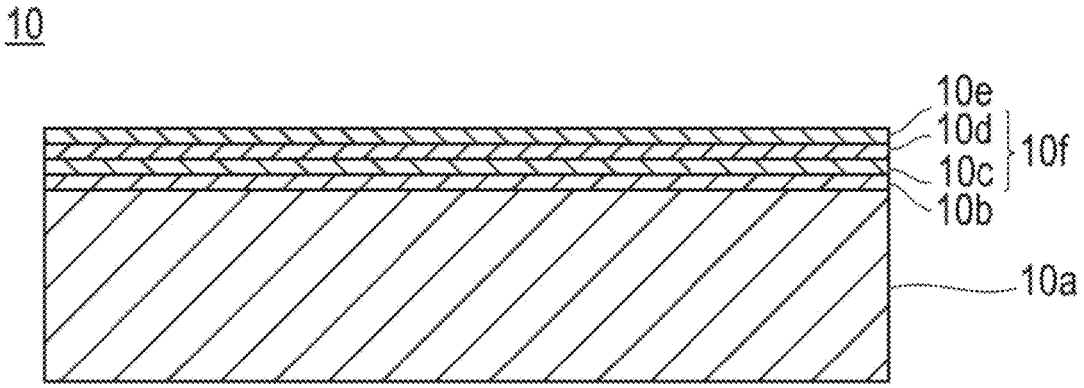
FIG. 2 is a partial sectional view illustrating an example of a layer configuration of an electrophotographic photoreceptor configuring the image forming apparatus according to the embodiment of the present invention.

As illustrated in FIG. 2, for example, an intermediate layer 10*b*, an electric charge generating layer 10*c*, an electric charge transport layer 10*d*, and an outermost surface layer 10*e* are laminated on a conductive support body 10*a* in this order, and thus, the photoreceptor 10 is formed, as an electrophotographic photoreceptor having a layer configuration according to the embodiment of the present invention. A photosensitive layer 10*f* requisite for configuring the photoreceptor is configured of the electric charge generating layer 10*c* and the electric charge transport layer 10*d*. In the outermost surface layer 10*e*, the core material is the inorganic particles, and the inorganic particles contain the composite structure particles (an average particle diameter of primary particles is 50 nm to 200 nm) coated with tin oxide doped with aluminum.

[Outermost Surface Layer]

In the layer configuring the outermost surface of the electrophotographic photoreceptor according to the embodiment of the present invention (also referred to as the outermost surface layer), the core material is the inorganic particles, and the inorganic particles contain the composite structure particles (an average particle diameter of primary particles is 50 nm to 200 nm) coated with tin oxide doped with aluminum (Al). It is preferable that the outermost surface layer further contains a resin binder, and the content of the composite structure particles is in a range of 50 parts by mass to 250 parts by mass with respect to 100 parts by mass of the resin binder. Hereinafter, each constituent (constituent component) of the outermost surface layer will be described.

<Composite Structure Particles>

In the composite structure particles contained in the layer configuring the outermost surface of the electrophotographic photoreceptor, the core material is the inorganic particles, and the inorganic particles are coated with tin oxide doped with aluminum (Al).

(Core Material; Inorganic Particles)

The core material configuring the composite structure particles is the inorganic particles. By using the inorganic particles in the core material, it is possible to apply the mechanical strength to the outermost surface layer, to increase a surface hardness, and to improve abrasion resistance or scratch resistance of the outermost surface layer. Further, it is preferable that an increase in a residual electric potential on the surface of the outermost surface layer or the generation of an image memory can be suppressed. In addition, it is preferable that the inorganic particles have small specific permittivity, and have an advantage of enabling charging properties of the outermost surface layer to be ensured from the viewpoint of the electrostatic properties. Further, it is preferable that the inorganic particles have small specific weight, are not precipitated in the coating liquid, and are capable of improving manufacturing stability of the outermost surface layer. Examples of the inorganic particles include barium sulfate ($BaSO_4$), silicon dioxide (silica; $SiO_2$), aluminum oxide (alumina; $Al_2O_3$), titanium oxide (titania; $TiO_2$), zinc oxide (ZnO), copper oxide (CuO), cerium oxide (seria; $CeO_2$), and the like, from the viewpoint of applying the mechanical strength as described above. One type thereof may be independently used, or two or more types thereof may be used together. In addition, a commercially available product may be used, or a synthetic product may be used, as such inorganic particles. A product described below is preferable. That is, the composite structure particles are conductive particles having n type conductivity. It is not possible for the positive electric charges to cancel the negative electric charges in the n type conductive particles. For this reason, it is necessary for the electric charges on the conductive particles to be supported on the surface of the conductive particles. For this reason, it is preferable that the core material used in the composite structure particles is the inorganic particles not having conductivity, and $BaSO_4$, $SiO_2$, and $Al_2O_3$ are preferable from the viewpoint of transparence after the outermost surface layer is formed. Here, "not having conductivity" represents that resistivity, for example, is greater than or equal to $10^{12}$ Ωcm. Furthermore, the resistivity of the inorganic particles, which are the core material, can be similarly measured to volume resistivity of the composite structure particles described below.

(Average Particle Diameter of Primary Particles of Inorganic Particles)

The average particle diameter of the primary particles of the inorganic particles, which are the core material, is preferably in a range of 30 nm to 200 nm, is more preferably in a range of 50 nm to 200 nm, is even more preferably in a range of 50 nm to 180 nm, and is particularly preferably in a range of 80 nm to 150 nm, from the viewpoint of applying the mechanical strength as described above, of further maintaining the electric characteristics, and of reducing the discharge point portion by using the particles having a large particle diameter in order to reduce the discharge point. Setting the average particle diameter to be greater than or equal to 30 nm, and to be preferably greater than or equal to 50 nm is excellent from the viewpoint of enabling the amount of inorganic particles contained in the outermost surface layer of the photoreceptor (the composite structure particles using the inorganic particles as the core material is in a range of 50 parts by mass to 250 parts by mass with respect to 100 parts by mass of the resin binder) not to excessively increase, and of reducing the discharge point portion. For this reason, it is excellent from the viewpoint of enabling sufficient film strength to be applied with respect to discharge. Setting the average particle diameter of the primary particles of the inorganic particles to be less than or equal to 200 nm, and to be preferably less than or equal to 180 nm is excellent from the viewpoint of enabling the content of the inorganic particles in the outermost surface layer of the photoreceptor not to excessively decrease, and the electric characteristics as the photoreceptor to be sufficiently satisfied. Furthermore, the average particle diameter (an average primary particle diameter) of the primary particles can be measured by volume-based particle diameter measurement of the particles according to a laser diffraction method. Furthermore, other particles, for example, the average particle diameter (the average primary particle diameter) of the primary particles such as the composite structure particles, can be measured by a similar method as that described above.

(Content of inorganic Particles with respect to Total Amount of Composite Structure Particles)

The content of the inorganic particles is preferably 20 mass % to 90 mass %, and is more preferably 30 mass % to 70 mass %, with respect to the total amount of the composite structure particles. According to such a range, it is possible to efficiently obtain the effect of the embodiment of the present invention. Furthermore, here, the "composite structure particles" represent an aspect in which the composite structure particles are contained in the outermost surface layer of the photoreceptor. For example, in a case where the surface treatment and/or the fluorine resin coating described below are performed, the composite structure particles which are subjected to the surface treatment and/or the fluorine resin coating are a target. In addition, in a case where the surface treatment and/or the fluorine resin coating are not performed, the composite structure particles which are not subjected to the surface treatment and/or the fluorine resin coating are a target.

(Tin Oxide Doped with Aluminum and Coating Inorganic Particles)

Tin oxide doped with aluminum and coating the inorganic particles (the core material) configuring the composite structure particles (hereinafter, simply referred to as "tin oxide doped with Al") is capable of setting the inorganic particles (the core material) to be the composite structure particles having resistance to discharge, and by containing the particles, it is possible to suppress the discharge degradation at the time of roller charging, to have excellent abrasion resistance, and to form an excellent image.

(Doping Amount of Aluminum)

In tin oxide doped with Al and coating the inorganic particles, a doping amount of aluminum (Al) with respect to 100 parts by mass of tin oxide, for example, is in a range of 0.05 part by mass to 1 part by mass, and is preferably in a range of 0.05 part by mass to 0.5 part by mass. By setting the doping amount of Al to be in the range described above, it is possible to satisfy the electric characteristics required as the photoreceptor. Setting the doping amount of Al to be greater than or equal to 0.05 part by mass is excellent from the viewpoint of enabling the volume resistivity of the composite structure particles not to excessively decrease, and of the electric charges to be retained. On the other hand, setting the doping amount of Al to be less than or equal to 1 part by mass is excellent from the viewpoint of enabling the volume resistivity of the composite structure particles not to excessively increase, the electric charges to excellently (smoothly) pass through the composite structure particles, and a required electric potential after exposure to be sufficiently obtained. The doping amount of Al in tin oxide doped with Al can be measured by a fluorescence X-ray analysis device or the like.

(Forming Method of Composite Structure Particles; Including Aluminum Doping Method)

A forming method of the composite structure particles (including a method of doping tin oxide with Al) is not particularly limited, and a known method of the related art can be suitably used. For example, the composite structure particles can be manufactured by a forming method (1) or a forming method (2) described below.

Forming Method (1) of Composite Structure Particles

A manufacturing method of the composite structure particles, including: a step of mixing slurry in which the inorganic particles, which are the core material, are dispersed in a medium, with a tin source compound; a step of manufacturing particles with a precipitate by adjusting pH of the obtained mixed slurry, and by generating a precipitate containing tin on the surface of the inorganic particles (the core material); a step of adding an aluminum source compound to the mixed slurry, and of supplying the aluminum to the particles with a precipitate; a step of calcining the particles with a precipitate, and a step of generating the precipitate on the surface of the inorganic particles (the core material), in which a shear force is applied to the mixed slurry by a homogenizer, or the mixed slurry is irradiated with an ultrasonic wave.

Forming Method (2) of Composite Structure Particles

A manufacturing method of the composite structure particles, including: a step of mixing slurry in which the inorganic particles, which are the core material, are dispersed in a medium, with a tin source compound, and an aluminum source compound; a step of manufacturing coparticles with a precipitate by adjusting pH of the obtained mixed slurry, by generating a coprecipitate containing tin and aluminum on the surface of the inorganic particles (the core material); a step of calcining the coparticles with a precipitate; and a step of generating the coprecipitate on the surface of the inorganic particles (the core material), in which a shear force is applied to the mixed slurry by a homogenizer, or the mixed slurry is irradiated with an ultrasonic wave.

First, the forming method (1) of the composite structure particles will be described. In this forming method, first, the slurry in which the inorganic particles, which are the core material, are dispersed in the medium, and the tin source compound are mixed. In compounding ratios of water and the core material in the slurry, the core material with respect to 1 liter of water is preferably greater than or equal to 10 g and less than or equal to 100 g, and is even more preferably greater than or equal to 30 g and less than or equal to 80 g. In a case where the compounding ratios of both of water and the core material are in the range described above, a homogeneous coating substance or coating layer of tin oxide is easily obtained. For example, an aqueous tin compound can be used as the tin source compound. A precipitate containing tin can be attached onto the surface of the core material as the aqueous tin compound, but is not particularly limited. For example, sodium stannate, tin tetrachloride, or the like can be used. In the compounding ratios of water and the tin source compound in the mixed slurry obtained by mixing both of water and the core material, an Sn concentration of the tin source compound with respect to water is preferably greater than or equal to 1 mass % and less than or equal to 20 mass %, and is even more preferably greater than or equal to 3 mass % and less than or equal to 10 mass %. In a case where the compounding ratios of water and the tin source compound are in the range described above, a homogeneous coating substance or coating layer of tin oxide is easily obtained.

Next, pH of the mixed slurry to which the tin source compound is added is adjusted. The pH adjustment is performed by adding an acid or a base. A neutralization reaction of the tin source compound is performed according to the pH adjustment. Examples of a method of performing the neutralization reaction include a method of adding an acid substance or a basic substance to the slurry. Examples of the acid substance include a sulfuric acid, a nitric acid, an acetic acid, and the like. In a case of using the sulfuric acid, when the sulfuric acid is used in a state of a diluted sulfuric acid, a homogeneous coating substance or coating layer of tin oxide is easily obtained. The concentration of the diluted sulfuric acid is generally 10 content % to 50 content %. Examples of the basic substance include sodium hydroxide, ammonia water, and the like. Among them, sodium hydroxide is preferable since the concentration is easily managed. The precipitate containing tin is generated on the surface of the core material by a neutralization reaction of the tin source compound, and thus, the particles with a precipitate are obtained. pH of the mixed slurry after being neutralized is preferably greater than or equal to 0.5 and less than or equal to 5, is more preferably greater than or equal to 2 and less than or equal to 4, and is even more preferably greater than or equal to 2 and less than or equal to 3.

When the neutralization reaction of the tin source compound is performed according to the pH adjustment of the mixed slurry, and the precipitate containing tin is generated on the surface of the core material, it is advantageous that a shear force is applied to the mixed slurry by a homogenizer or the mixed slurry is irradiated with an ultrasonic wave. By performing such an operation, a decrease in a crystallite diameter of tin oxide due to the addition of aluminum is suppressed, and the composite structure particles excellent for environment resistance (abrasion resistance) are obtained. In a case where a shear force is applied to the mixed slurry by a homogenizer, and in a case where the mixed slurry is irradiated with an ultrasonic wave, it is preferable to adopt a method in which a reaction device in which a homogenizer or an ultrasonic wave vibrator is disposed on a part of a circulation route is used, and the acid substance or the basic substance is added to a disposition position of the homogenizer or the ultrasonic wave vibrator while the mixed slurry containing the tin source compound is circulated in the circulation route. Alternatively, it is also preferable that the ultrasonic wave vibrator is disposed in a mother water tank, and the mixed slurry is directly irradiated with an ultrasonic wave.

In a case of using a homogenizer, it is preferable that a stirring rate is greater than or equal to 5000 rpm, and is particularly greater than or equal to 10000 rpm. The upper limit value of the stirring rate is not particularly limited, but it is preferable that the upper limit value of the stirring rate is high, and in a case where the stirring is performed at a high rate of approximately 16000 rpm, a reduction in the crystallite diameter of tin oxide due to the addition of aluminum is effectively suppressed, and the composite structure particles excellent for the environment resistance (the abrasion resistance) are obtained. On the other hand, in the case of using an ultrasonic wave vibrator, it is preferable that an ultrasonic wave frequency is greater than or equal to 10 kHz and less than or equal to 10 MHz, is particularly greater than or equal to 20 kHz and less than or equal to 5 MHz, and is especially greater than or equal to 20 kHz and less than or equal to 50 kHz, and an ultrasonic wave output is greater than or equal to 50 W and less than or equal to 20 kW, and is particularly greater than or equal to 500 W and less than or equal to 4000 W.

For example, a device described in JP 2009-255042 A and JP 2010-137183 A can be used as the reaction device in which a homogenizer or an ultrasonic wave vibrator is disposed in a part of the circulation route.

The neutralization reaction of the tin source compound is performed as described above, and thus, the particles in which the precipitate of the tin compound is attached onto the surface of the core material (also referred to as the particles with a precipitate) are obtained. Continuously, the aluminum source compound is added to the mixed slurry, and aluminum is supplied to the particles with a precipitate. It is preferable that an aqueous compound is used as the aluminum source compound. The compound may be added in a state of an aqueous solution, or may be dissolved in the mixed slurry by being added in a state of a solid. For example, aluminum chloride (or a hydrate thereof) can be used as the aluminum source compound.

The aluminum source compound is added to the mixed slurry, and then, the mixed slurry is stirred, and thus, aluminum is attached onto the surface of the particles with a precipitate. Aluminum is attached in a state of an ion, or in a state of a precipitate such as hydroxide or oxyhydroxide. In a case where it is difficult to attach aluminum onto the surface of the particles with a precipitate, the attachment may be accelerated by performing the pH adjustment with an acid or an alkali.

Thus, the particles with a precipitate, which are the precursor of the composite structure particles in which the surface of the core material is coated with the precipitate containing tin, are obtained. Next, the precursor is washed with water. The washed precursor is dried after being subjected to dehydration and filtration.

The dried precursor is transported to a calcining step. A reduction atmosphere, and an inactive atmosphere or an oxidation atmosphere can be used as a calcining atmosphere. In a case of using the reduction atmosphere, desired composite structure particles can be obtained at a comparatively low calcining temperature. On the other hand, in the case of using the inactive atmosphere or the oxidation atmosphere, it is desirable that a calcining temperature is set to be higher than that of a case of using the reduction atmosphere. In particular, in the case of using the reduction atmosphere, the crystallite diameter of tin oxide doped with Al can be easily set to be in a desired range (5 nm to 20 nm) due to a mutual interaction with aluminum contained in the precipitate. Examples of the reduction atmosphere include a nitrogen atmosphere in which hydrogen having a concentration less than an explosion limit is contained. The concentration of hydrogen in the nitrogen atmosphere where hydrogen is contained is preferably greater than or equal to 0.1 volume % and less than or equal to 10 volume %, and is even more preferably greater than or equal to 1 volume % and less than or equal to 3 volume %, which is the concentration less than the explosion limit. In a case where the concentration of hydrogen is within the range described above, a reduction in the crystallite diameter of tin oxide due to the addition of aluminum is effectively suppressed without reducing tin to a metal, and the composite structure particles excellent for the environment resistance (the abrasion resistance) are obtained. Furthermore, the crystallite diameter of tin oxide doped with Al is measured by the following method. That is, XRD measurement is performed by using an X-ray diffraction device of Ultima IV (manufactured by Rigaku Corporation) (Condition: X-ray CuKα, 40 kV, and 50 mA, a measurement range of 20°≤2θ≤100°, Radiation Source: CuKα, Scanning Axis: 2θ/θ, Measurement Method: FT, Coefficient Unit: Counts, Step Width: 0.01°, Coefficient Time: 10 seconds, Divergence Slit: 2/3°, Divergence Longitudinal Restriction Slit: 10 mm, Scattering Slit: 2/3°, Light Receiving Slit: 0.3 mm, and Monochrome Light Receiving Slit: 0.8 mm), and subsequently, measurement data is read by using analysis software PDXL manufactured by Rigaku Corporation (using ICDD Card of $SnO_2$: 00-046-1088), and thus, the crystallite diameter can be calculated by a Halder-Wagner method after being refined (width correction is performed according to an external standard sample, and an analysis target is set to the crystallite diameter and lattice distortion).

In a case of using the reduction atmosphere, the calcining temperature is preferably higher than 400° C. and lower than or equal to 1200° C., and is even more preferably higher than or equal to 500° C. and lower than or equal to 900° C. In a case of using the inactive atmosphere or the oxidation atmosphere, it is preferable that a calcining temperature higher or equal to 150° C. from the temperature. The calcining time is preferably longer than or equal to 5 minutes and shorter than or equal to 60 minutes, and is even more preferably longer than or equal to 10 minutes and shorter than or equal to 30 minutes, in a condition where the calcining temperature is within the range described above. In a case where the calcining condition is within the range described above, a reduction in the crystallite diameter of tin oxide due to the addition of aluminum is effectively suppressed while tin oxide is prevented from being sintered, and the composite structure particles excellent for the environment resistance (the abrasion resistance) are obtained.

Next, the forming method (2) of the composite structure particles will be described. This forming method is different from the forming method (1) in that the slurry in which the inorganic particles, which are the core material, are dispersed in the medium, the tin source compound, and the aluminum source compound are mixed. The slurry, the tin source compound, and the aluminum source compound are mixed, and pH of the mixed slurry is adjusted, and thus, the coprecipitate containing tin and aluminum is generated on the surface of the core material, and the coparticles with a precipitate are obtained. Then, in the step of generating the coprecipitate, a shear force is applied to the mixed slurry by a homogenizer, or the mixed slurry is irradiated with an ultrasonic wave. The obtained coparticles with a precipitate are calcined as with the forming method (1). Thus, desired composite structure particles are obtained.

(Coated Aspect of Tin Oxide Doped with Al)

In addition, (1) tin oxide doped with Al may be homogeneously and continuously coating a surface of an inorganic material, which is the core material, such that the entire surface of the inorganic material is not exposed, or (2) tin oxide doped with Al may be discontinuously coating the surface of the inorganic material, which is the core material, such that a part of the surface of the inorganic material is exposed, within a range not impairing the effect of the embodiment of the present invention. In general, as illustrated in FIG. 4B described below, the latter aspect is used. In the latter aspect, the surface of the inorganic material is coated with tin oxide doped with Al in a state where particle-like (or disk-like) tin oxides doped with Al are in contact with each other, and thus, a portion is formed in which a part of the surface of the inorganic material is exposed.

(Content of Tin Oxide Doped With Al instead of Thickness)

It is not necessary that the thickness of the coating substance of tin oxide doped with Al (in the case of the discontinuous coating of (2) described above) or the coating layer (in the case of the continuous coating of (1) described above) is excessively thick, insofar as the conductivity of the coating substance or the coating layer is sufficiently exhibited. In a case where the thickness of the coating substance or the coating layer is converted into the amount of tin oxide, the content of tin oxide doped with Al is preferably 30 mass % to 70 mass %, and is more preferably 40 mass % to 60 mass %, with respect to the total amount of the composite structure particles. According to such a range, it is possible to more efficiently obtain the effect according to the embodiment of the present invention. The amount of tin and aluminum in the composite structure particles can be obtained by measuring a solution which is obtained by dissolving the coating substance or the coating layer of the composite structure particles described above in an acid, with an ICP spectrophotometer. Furthermore, here, the "composite structure particles" represent an aspect of being contained in the outermost surface layer of the photoreceptor. For example, in a case where the surface treatment and/or the fluorine resin coating described below are performed, the composite structure particles which are subjected to the surface treatment and/or the fluorine resin coating are a target. In addition, in a case where the surface treatment and/or the fluorine resin coating are not performed, the composite structure particles which are not subjected to the surface treatment and/or the fluorine resin coating are a target.

(Average Particle Diameter of Primary Particles of Composite Structure Particles)

The average particle diameter of the primary particles of the composite structure particles is in a range of 50 nm to 200 nm, is preferably in a range of 80 nm to 150 nm, and is more preferably in a range of 100 nm to 120 nm, from the viewpoint of applying the mechanical strength as described above, of further maintaining the electric characteristics, and of reducing the discharge point portion by using the particles having a large particle diameter in order to reduce the discharge point. In a case where the average particle diameter of the primary particles of the composite structure particles is less than 50 nm, the amount of composite structure particles contained in the outermost surface layer of the photoreceptor increases, and the discharge point increases (in a range of 50 parts by mass to 250 parts by mass of the composite structure particles with respect to 100 parts by mass of the resin binder). For this reason, intensity of a film (the outermost surface layer) with respect to discharge is degraded. In a case where the average particle diameter of the primary particles of the composite structure particles is greater than 200 nm, the content of the composite structure particles in the outermost surface layer decreases, and thus, it is not possible to satisfy the electric characteristics as the photoreceptor. Furthermore, the average particle diameter of the primary particles (the average primary particle diameter) can be measured by volume-based particle diameter measurement of the particles according to a laser diffraction method. The average particle diameter of the primary particles (the average primary particle diameter) is measured regardless of the presence or absence of the surface treatment and/or the fluorine resin coating, and the composite structure particles in a state where the surface treatment and/or the fluorine resin coating are not performed, are measured.

In a case where the outermost surface layer of the photoreceptor is analyzed, and the average particle diameter of the primary particles of the inorganic particles (a number average primary particle diameter) is calculated, the average particle diameter can be calculated as follows. A photograph of a sectional surface of the outermost surface layer of the photoreceptor can be photographed in magnification of 10000 times by a scanning electronic microscope (manufactured by JEOL Ltd.), and a photograph image in which 300 composite structure particles are randomly captured by a scanner (excluding agglomerated particles) can be calculated by using an automatic image treatment analysis device LUZEX AP (manufactured by NIRECO CORPORATION) and software version Ver. 1.32. In this case, the average particle diameter of the primary particles (the number average primary particle diameter) is measured regardless of the presence or absence of the surface treatment and/or the fluorine resin coating, and the composite structure particles (an inorganic substance) not including a portion of a treated film and a coated film (an organic substance) according to the which are not subjected to the surface treatment and/or the fluorine resin coating are measured.

(Volume Resistivity of Composite Structure Particles)

The volume resistivity of the composite structure particles, for example, is in a range of $10^1$ Ωcm to $10^8$ Ωcm, is preferably in a range of $1.0\times10^4$ Ωcm to $9.9\times10^7$ Ωcm, and is more preferably in a range of $1.0\times10^5$ Ωcm to $9.9\times10^6$ Ωcm, at 25° C. By setting the volume resistivity to be in the range described above, it is possible to satisfy the electric characteristics required as the photoreceptor. It is preferable that the volume resistivity is greater than or equal to $10^1$ Ωcm from the viewpoint of enabling surface resistance of a film of the composite structure particles (tin oxide doped with Al and coating the inorganic particles) not to excessively decrease, and sufficient electric charges to be retained. On the other hand, it is preferable that the volume resistivity is less than or equal to $10^8$ Ωcm from the viewpoint of enabling the surface resistance of the composite structure particles not to excessively increase, the electric charges to pass through the composite structure particles, and a required electric potential after exposure to be sufficiently obtained. The volume resistivity, for example, is measured by using a powder compacting resistance measure system (PD-41, manufactured by Mitsubishi Chemical Corporation) and a resistivity measuring device (MCP-T600, manufactured by Mitsubishi Chemical Corporation). 15 g of a sample (the composite structure particles) is put into a probe cylinder, and a probe unit is set in PD-41. A resistance value at the time of applying a pressure of 500 kgf/cm$^2$ by a hydraulic jack is measured by using MCP-T600. Powder compacting resistance (the volume resistivity) is calculated from the measured resistance value and the thickness of the sample. The measurement may be performed with respect to an aspect of the composite structure particles contained in the outermost surface layer of the photoreceptor, as a measurement timing. For example, in a case where the surface treatment and/or the fluorine resin coating are not performed, the measurement may be performed after the composite structure particles which are not subjected to such treatments, are formed. In addition, in a case where the surface treatment (a silane coupling agent treatment) and/or the fluorine resin coating are performed after the composite structure particles are formed, the measurement may be performed after the surface treatment (the silane coupling agent treatment) and/or the fluorine resin coating. The measurement method can be performed in any aspect without being changed.

(Content of Composite Structure Particles)

In a case where the layer configuring the outermost surface of the photoreceptor (the outermost surface layer) further contains the resin binder in addition to the composite structure particles, the content of the composite structure particles is preferably in a range of 50 parts by mass to 250 parts by mass, and is more preferably in a range of 70 parts by mass to 200 parts by mass, with respect to 100 parts by mass of the resin binder. According to such a range, it is possible to more efficiently obtain the effect according to the embodiment of the present invention. In a case where the content of the composite structure particles with respect to the resin binder is greater than or equal to 50 parts by mass, sufficient resistance is obtained with respect to discharge. Further, it is possible not to excessively decrease a conductive portion (=the composite structure particles), which is a route of the electric charges in the outermost surface layer, to effectively prevent passing properties of the electric charges from being degraded, and to obtain an electric potential required after exposure. On the other hand, in a case where the content of the composite structure particles with respect to the resin binder is less than or equal to 250 parts by mass, it is possible not to excessively increase the composite structure particles in the outermost surface layer, to suppress an increase in the number of discharge point at the time of discharge, and to effectively prevent a decrease in the resistance with respect to discharge. Furthermore, here, the "composite structure particles" represent an aspect of being contained in the outermost surface layer of the photoreceptor. For example, in a case where the surface treatment and/or the fluorine resin coating described below are performed, the composite structure particles which are subjected to the surface treatment and/or the fluorine resin coating are a target. In addition, in a case where the surface treatment and/or the fluorine resin coating are not performed, the composite structure particles which are not subjected to the surface treatment and/or the fluorine resin coating are a target.

(Composite Structure Particles Subjected to Surface Treatment with Surface Treatment Agent)

It is preferable that the composite structure particles is subjected to a surface treatment with a surface treatment agent, and it is even more preferable that the composite structure particles is subjected to a surface treatment with a surface treatment agent having a reactive organic group, from the viewpoint of dispersibility.

A surface treatment agent reacting with a hydroxy group or the like on the surface of the composite structure particles before the treatment is preferably used as the surface treatment agent, and examples of the surface treatment agent include a silane coupling agent, a titanium coupling agent, and the like.

In addition, in the embodiment of the present invention, it is preferable to use the surface treatment agent having a reactive organic group, and it is more preferable to use a surface treatment agent in which the reactive organic group is a polymerizable reactive group, in order to further increase the hardness of the outermost surface layer of the photoreceptor. By using the surface treatment agent having a polymerizable reactive group, it is possible to form a rigid protective film in order to react with the polymerizable compound in a case where the resin binder is a polymerized cured substance of a polymerizable compound described below (a curable resin).

A silane coupling agent having an acryloyl group or a methacryloyl group is preferable as the surface treatment agent having the polymerizable reactive group. The surface treatment is performed by using the surface treatment agent containing the acryloyl group or the methacryloyl group, and thus, the composite structure particles are bonded to the resin binder by a covalent bond through the surface treatment agent, and a rigid outermost surface layer can be formed. Known compounds described below are exemplified as such a surface treatment agent having a polymerizable reactive group.

Compounds as described below are exemplified as the silane coupling agent having an acryloyl group or a methacryloyl group.

Chemical Formula 1

S1: $CH_2{=}CHCOO(CH_2)_2Si(CH_3)(OCH_3)_2$
S2: $CH_2{=}CHCOO(CH_2)_2Si(OCH_3)_3$
S3: $CH_2{=}CHCOO(CH_2)_2Si(OC_2H_5)(OCH_3)_2$
S4: $CH_2{=}CHCOO(CH_2)_3Si(OCH_3)_3$
S5: $CH_2{=}CHCOO(CH_2)_2Si(CH_3)Cl_2$
S6: $CH_2{=}CHCOO(CH_2)_2SiCl_3$
S7: $CH_2{=}CHCOO(CH_2)_3Si(CH_3)Cl_2$
S8: $CH_2{=}CHCOO(CH_2)_3SiCl_3$
S9: $CH_2{=}C(CH_3)COO(CH_2)_2Si(CH_3)(OCH_3)_2$
S10: $CH_2{=}C(CH_3)COO(CH_2)_2Si(OCH_3)_3$
S11: $CH_2{=}C(CH_3)COO(CH_2)_3Si(CH_3)(OCH_3)_2$
S12: $CH_2{=}C(CH_3)COO(CH_2)_3Si(OCH_3)_3$
S13: $CH_2{=}C(CH_3)COO(CH_2)_2Si(CH_3)Cl_2$
S14: $CH_2{=}C(CH_3)COO(CH_2)_2SiCl_3$
S15: $CH_2{=}C(CH_3)COO(CH_2)_3Si(CH_3)Cl_2$
S16: $CH_2{=}C(CH_3)COO(CH_2)_3SiCl_3$
S17: $CH_2{=}CHCOOSi(OCH_3)_3$
S18: $CH_2{=}CHCOOSi(OC_2H_6)_3$
S19: $CH_2{=}C(CH_3)COOSi(OCH_3)_3$
S20: $CH_2{=}C(CH_3)COOSi(OC_2H_5)_3$
S21: $CH_2{=}C(CH_3)COO(CH_2)_3Si(OC_2H_5)_3$
S22: $CH_2{=}CHCOO(CH_2)_2Si(CH_3)_2(OCH_3)$
S23: $CH_2{=}CHCOO(CH_2)_2Si(CH_3)(OCOCH_3)_2$
S24: $CH_2{=}CHCOO(CH_2)_2Si(CH_3)(ONHCH_3)_2$
S25: $CH_2{=}CHCOO(CH_2)_2Si(CH_3)(OC_6H_5)_2$
S26: $CH_2{=}CHCOO(CH_2)_2Si(C_{10}H_{21})(OCH_3)_2$
S27: $CH_2{=}CHCOO(CH_2)_2Si(CH_2C_6H_5)(OCH_3)_2$

A silane compound having a reactive organic group, which is capable of performing a polymerization reaction, can be used as the surface treatment agent, in addition to Chemical Formulas S1 to S27 described above. Such surface treatment agents can be independently used, or two or more types thereof can be used by being mixed. In addition, a synthetic product may be used, or a commercially available product may be used, in such a surface treatment agent. Examples of the commercially available product include silane coupling agents KBM-502, KBM-503, KMB-5103, KBE-503, and the like, manufactured by Shin-Etsu Chemical Co., Ltd., but are not limited thereto.

A used amount of the surface treatment agent is not particularly limited, but it is preferable that the used amount of the surface treatment agent is 0.1 part by mass to 100 parts by mass with respect to 100 parts by mass of the composite structure particles before the treatment. That is, it is preferable that the composite structure particles are subjected to the surface treatment (surface treated film is formed) with the surface treatment agent in a range of 0.1 part by mass to 100 parts by mass with respect to 100 parts by mass of the composite structure particles before the treatment. Further, it is more preferable that the composite structure particles are subjected to the surface treatment (the surface treated film is formed) with the surface treatment agent having a polymerizable reactive group in a range of 0.5 part by mass to 10 parts by mass with respect to 100 parts by mass of the composite structure particles before the treatment. According to such a range, it is possible to more efficiently obtain the effect according to the embodiment of the present invention. It is preferable that the surface treatment agent having a polymerizable reactive group is greater than or equal to 0.5 part by mass with respect to 100 parts by mass of the composite structure particles before the treatment since a cross-linked structure can be formed between the resin binder and the composite structure particles at the time of being cured. On the other hand, it is preferable that the surface treatment agent having a polymerizable reactive group is less than or equal to 10 parts by mass with respect to 100 parts by mass of the composite structure particles before the treatment since the surplus surface treatment agent does not remain in the surface layer, and thus, does not affect the image quality. Furthermore, the "composite structure particles before the treatment" represent composite structure particles in a state of not being subjected to the surface treatment or the coating with the surface treatment agent, a fluorine resin, or the like. In addition, the silane coupling agent (the surface treatment agent), the fluorine resin, and the used amount thereof (the content of a surface treated film or a fluorine resin film derived from the silane coupling agent or the fluorine resin) can be analyzed by peeling off the outermost surface layer of the photoreceptor, and by using an X-ray photoelectric spectroscopy.

[Surface Treatment Method of Composite Structure Particles with Surface Treatment Agent]

Specifically, the surface treatment of the composite structure particles can be performed by performing wet pulverization with respect to slurry containing the composite structure particles before the treatment and the surface treatment agent (a suspension of solid particles), and by performing surface treatment of the particles along with the refinement of the composite structure particles, and then, by making a powder by removing a solvent.

It is preferable that in the slurry, the surface treatment agent of 0.1 part by mass to 100 parts by mass, the solvent of 50 parts by mass to 5000 parts by mass are mixed, with respect to the composite structure particles before the treatment 100 parts by mass.

In addition, examples of a device used for the wet pulverization of the slurry include a wet media dispersion device. The wet media dispersion device is a device having a step of filling a container with beads as media, by rotating a stirring disk perpendicularly attached to a rotation axis at a high rate, and by pulverizing and dispersing agglomerated particles of P type semiconductor particles, and the device may have a configuration in which the surface treatment can be performed by sufficiently dispersing the composite structure particles at the time of performing the surface treatment with respect to the composite structure particles, and for example, various devices such as a vertical type device, a horizontal type device, a continuous type device, and a batch type device. Specifically, a sand mill, an ultra visco mill, a pearl mill, a glen mill, a dyno mill, an agitator mill, a dynamic mill, and the like can be used. In such dispersion devices, fine pulverization and dispersion are performed by using a pulverize medium (media) such as balls and beads, according to an impact indentation, friction, shear, a shear stress, and the like.

Beads containing glass, alumina, zircon, zirconia, steel, flint, and the like as a raw material, can be used as the beads used in the wet media dispersion device, and in particular, it is preferable that balls of zirconia, zircon, and alumina are used. In addition, in general, beads having a diameter of approximately 1 mm to 2 mm are used as the size of the beads, but in the embodiment of the present invention, it is preferable that beads having a diameter of approximately 0.1 mm to 1.0 mm are used.

Various materials such as stainless steel, nylon, and ceramic can be used in the disk or the inner wall of the container in the wet media dispersion device, in the embodiment of the present invention, in particular, it is preferable that the disk or the inner wall of the container is formed of ceramic such as zirconia or silicon carbide.

(Composite Structure Particles Coated with Fluorine Resin)

It is preferable that the composite structure particles are coated with the fluorine resin, and it is more preferable that the composite structure particles are subjected to the surface treatment with the surface treatment agent, and then, are coated with the fluorine resin. As the effect of coating the composite structure particles with the fluorine resin, it is possible to improve the resistance of the composite structure particles (the conductive particles) with respect to discharge by being coated with the fluorine resin having high insulating properties, and to suppress the hydrophilization of the composite structure particles due to discharge degradation. The suppression of the hydrophilization is capable of contributing not only to the improvement of the discharge resistance, but also to the improvement of the retainability of the electric charges, and of contributing the improvement of fine line properties under a high temperature and high humidity.

The fluorine resin is not particularly limited, and known fluorine resins of the related art can be used. For example, an aspect of a copolymer in which a monomer including a fluoroaliphatic group-containing unsaturated ester monomer and an unsaturated silane monomer is copolymerized (an aspect of the fluorine resin), described in JP 2002-146271 A, may be used, and an aspect of a coating composition containing the copolymer described above (an aspect of a coating agent) may be used. Alternatively, an aspect of a fluoroalkyl (meth)acrylate/(meth)acrylic acid copolymer (an aspect of the fluorine resin), described in JP 2013-028807 A, may be used, and an aspect of a coating composition containing the copolymer described above, and a partially fluorinated solvent (an aspect of the coating agent) may be used. At this time, the fluoroalkyl group has carbon atoms of less than or equal to 6, and in a case where the fluoroalkyl group is a perfluoroalkyl group, the copolymer containing a (meth)acrylic acid of less than or equal to 5 weight % can be used. A fluorine resin containing a fluorinated methacrylic acid polymer segment is preferable as the fluorine resin contained in the aspect of the fluorine resin or the coating agent, as with the fluoroalkyl (meth)acrylate/(meth)acrylic acid copolymer. This is because the fluorine resin contains the fluorinated methacrylic acid polymer segment, and thus, it is possible to further improve the effect of coating the composite structure particles with the fluorine resin. Here, the fluorine resin in the embodiment of the present invention (including the aspect of the coating agent) is not limited to the above description. A synthetic product may be used, or a commercially available product may be used, as the fluorine resin (including the aspect of the coating agent). Examples of the commercially available product include fluorine-based coating agents of Novec (Registered Trademark) 2702, Novec 1700, Novec 1720, and the like, manufactured by 3M Company, but are not limited thereto. A described above, the fluorine resin (the coating agent) of the fluorine-based coating agent of Novec (Registered Trademark) 2702 or the like contains a solvent in addition to the fluorine resin, and as described in examples, the composite structure particles and the fluorine resin (Novec (Registered Trademark) 2702 or the like) are mixed (=drying and solvent elimination are also performed), and thus, it is possible to coat the composite structure particles with the fluorine resin (the fluorine resin film is formed).

A used amount of the fluorine resin (including the aspect of the coating agent) is not particularly limited, and is preferably in a range of 0.1 part by mass to 100 parts by mass, and is more preferably in a range of 1 part by mass to 10 parts by mass, with respect to 100 parts by mass of the composite structure particles before the treatment. That is, the composite structure particles are coated with the fluorine resin which is preferably in a range of 0.1 part by mass to 100 parts by mass, and is more preferably in a range of 1 part by mass to 10 parts by mass (the fluorine resin film is formed), with respect to 100 parts by mass of the composite structure particles before the treatment. According to such a range, it is possible to more efficiently obtain the effect of the embodiment of the present invention. In a case where the fluorine resin is greater than or equal to 1 part by mass with respect to 100 parts by mass of the "composite structure particles before the treatment", it is possible to sufficiently obtain surface coating properties of the composite structure particles, and to suppress the hydrophilization of the surface of the composite structure particles at the time of discharge. For this reason, it is possible to sufficiently retain the electric charges even under a high temperature and high humidity environment, and to form an excellent image. In addition, in a case where the fluorine resin is less than or equal to 10 parts by mass, it is possible to sufficiently obtain the coating properties with respect to the composite structure particles, and to effectively suppress the degradation of the passing properties of the electric charges due to the fluorine resin having high insulating properties. For this reason, it is possible to sufficiently obtain an electric potential required after the photoreceptor is exposed, and to form an excellent image. Furthermore, the "composite structure particles before the treatment" represent composite structure particles in a state of not being subjected to the surface treatment or the coating with the surface treatment agent, the fluorine resin, or the like.

[Surface Treatment Method of Composite Structure Particles with Fluorine Resin]

The surface treatment of the composite structure particles with the fluorine resin is not particularly limited, and a known method of the related art can be used. For example, the coating method of the coating composition (in the aspect of the fluorine resin or the aspect of the coating agent), described in JP 2002-146271 A, may be used, or the coating method of the coating composition (in the aspect of the fluorine resin or in the aspect of the coating agent), described in JP 2013-028807 A, may be used.

[Configuration of Composite Structure Particles]

Figure 4A:
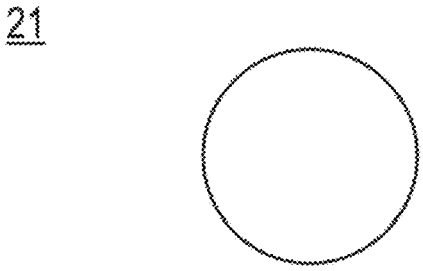
FIGS. 4A to 4D are sectional views for illustrating an example of a configuration of composite structure particles contained in a layer configuring the outermost surface of the electrophotographic photoreceptor configuring the image forming apparatus according to the embodiment of the present invention and a particle structure of a manufacturing process thereof.
Figure 4B:
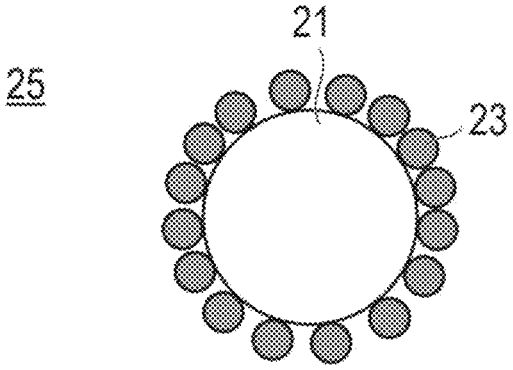
Figure 4C:
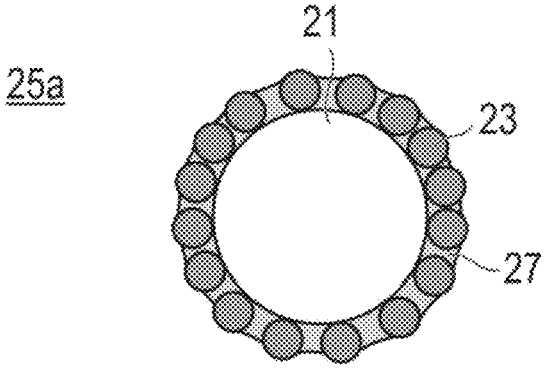
Figure 4D:
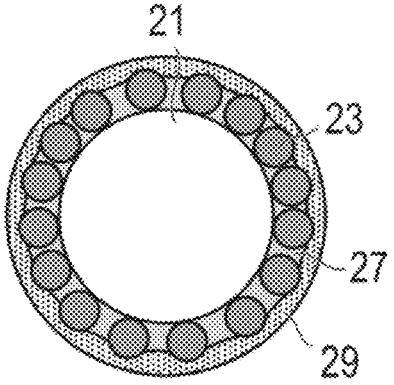

FIGS. 4A to 4D are sectional views for illustrating an example of a configuration of composite structure particles contained in a layer configuring the outermost surface of the electrophotographic photoreceptor configuring the image forming apparatus according to the embodiment of the present invention and a particle structure of a manufacturing process thereof. FIG. 4A is a sectional view for illustrating an example of an inorganic particle structure which is a core material prepared in the manufacturing process of the composite structure particles. FIG. 4B is a sectional view for illustrating an example of the structure of the composite structure particles in which the inorganic particles of FIG. 4A are coated with tin oxide doped with aluminum. FIG. 4C is a sectional view for illustrating an example of the structure of the composite structure particles in which the composite structure particles of FIG. 4B are subjected to a surface treatment with a surface treatment agent. FIG. 4D is a sectional view for illustrating an example of the structure of the composite structure particles in which the composite structure particles of FIG. 4C, subjected to the surface treatment with the surface treatment agent are coated with a fluorine resin. FIG. 4A illustrates a sectional surface of inorganic particles 21 used in the core material. An aspect illustrated in FIG. 4B illustrates a sectional surface of composite structure particles 25 in which a core material (the inorganic particles) 21 is coated with tin oxide 23 doped with aluminum (tin oxide doped with Al). As with the aspect illustrated in FIG. 4B, in the composite structure particles according to the embodiment of the present invention, the entire surface of the core material (the inorganic particles) 21 may not be necessarily coated with tin oxide 23 doped with Al. In the embodiment of the present invention, the composite structure particles 25 may be contained in the outermost surface layer of the photoreceptor, or the composite structure particles subjected to the following surface treatment may be contained in the outermost surface layer of the photoreceptor. An aspect illustrated in FIG. 4C illustrates a sectional surface of composite structure particles 25*a* in which the surface of the composite structure particles 25 of FIG. 4B are subjected to the surface treatment with the surface treatment agent. The surface of the composite structure particles 25 described above also include the surface of the inorganic particles 21 (a gap or the like between coating substances (granulated substances) of tin oxide 23 doped with Al), in addition to the surface of tin oxide 23 doped with Al and coating the inorganic particles 21. According to the surface treatment described above, the surface of the composite structure particles 25 (the inorganic particles 21, and tin oxide 23 doped with Al coating the inorganic particles 21) is coated with the surface treatment agent described above (a surface treated film 27 is formed). An aspect illustrated in FIG. 4D illustrates a sectional surface of composite structure particles 25*b* in which the composite structure particles 25*a* subjected to the surface treatment of FIG. 4C (the inorganic particles 21 subjected to the surface treatment of FIG. 4C, the surface of tin oxide 23 doped with Al subjected to the surface treatment of FIG. 4C, and the like) is coated with the fluorine resin. According to the fluorine resin coating, the surface of the composite structure particles 25*a* subjected to the surface treatment of FIG. 4C (the inorganic particles 21 subjected to the surface treatment of FIG. 4C, the surface of tin oxide 23 doped with Al subjected to the surface treatment of FIG. 4C, and the like) is coated with the fluorine resin described above (a fluorine resin film 29 is formed). A ratio of the size of the inorganic particles 21 to the size of the coating substance (the granulated substance) 23 of tin oxide 23 doped with Al is approximately the same as the actual ratio used in the examples.

(Resin Binder)

It is preferable that the outermost surface layer of the photoreceptor further contains the resin binder, in addition to the composite structure particles described above. Furthermore, the content of the resin binder is as described in the section of the composite structure particles described above. That is, it is preferable that the composite structure particles satisfy a requirement in which the content of the composite structure particles is in a range of 50 parts by mass to 250 parts by mass with respect to 100 parts by mass of the resin binder.

It is preferable that the resin binder is a thermoplastic resin or a photocurable resin, and in particular, the photocurable resin is more preferable since high film strength is obtained.

For example, a polyvinyl butyral resin, an epoxy resin, a polyurethane resin, a phenolic resin, a polyester resin, an alkyd resin, a polycarbonate resin, a silicone resin, an acrylic resin, a melamine resin, and the like can be used as the resin binder. In a case of using the thermoplastic resin, the polycarbonate resin is preferable. In addition, in the case of using the photocurable resin, a curable resin (=a polymerized cured substance of a polymerizable compound) obtained according to a polymerization reaction by irradiating a compound having two or more radical polymerizable functional groups (hereinafter, also referred to as a "multifunctional radical polymerizable compound" or a "polymerizable compound") with an active ray such as an ultraviolet ray or an electron ray is preferable. The polymerized cured substance of the polymerizable compound is used as the resin binder since resin binders (polymerizable compounds of a raw material) are connected to each other by a covalent bond at the time of being cured, and thus, rigid film quality can be formed as an outermost surface layer film. A film obtained as described above has a three-dimensional cross-linked structure, and thus, is capable of having the resistance with respect to discharge and physical scratch resistance, unlike an outermost surface layer formed of a two-dimensional thermoplastic resin. One type of the above-described resins exemplified as the resin binder can be independently used, or two or more types thereof can be used in combination.

[Multifunctional Radical Polymerizable Compound]

An acrylic monomer having two or more acryloyl groups ($CH_2{=}CHCO{-}$) or methacryloyl groups ($CH_2{=}CCH_3CO{-}$) as the radical polymerizable functional group, or an oligomer thereof is particularly preferable as the multifunctional radical polymerizable compound (the polymerizable compound), from the viewpoint of small light intensity or of enabling curing to be performed within a short period of time. Accordingly, an acrylic resin formed of an acrylic monomer or an oligomer thereof is preferable as the curable resin (the polymerized cured substance).

For example, the following compounds can be exemplified as the multifunctional radical polymerizable compound (the polymerizable compound).

[Chemical Formula 2]

M1

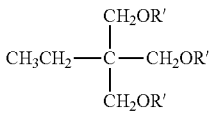

M2

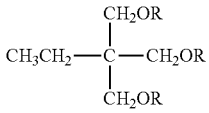

M3

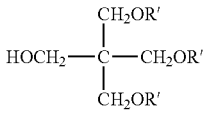

-continued

M4

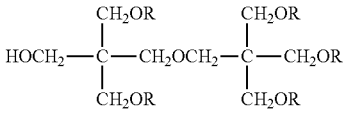

M5

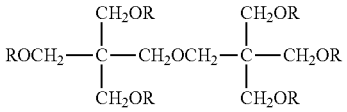

M6

$CH_3CH_2C\text{—}(CH_2OC_3H_6OR)_3$

M7

$CH_3CH_2C\text{—}(CH_2CH_2OR)_3$

[Chemical Formula 3]

M8

$R\text{—}(OC_3H_6)_3\text{—}OR$

M9

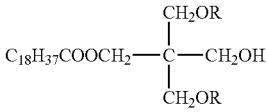

M10

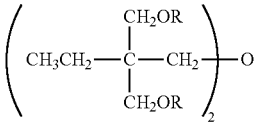

M11

$(ROCH_2)_4\text{—}C$

M12

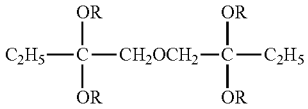

M13

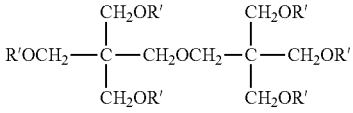

M14

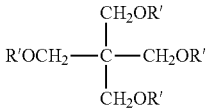

M15

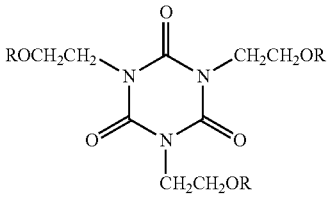

Here, in Chemical Formula representing Exemplary Compounds M1 to M15 described above, R represents an acryloyl group ($CH_2$=CHCO—), and R' represents a methacryloyl group ($CH_2$=$CCH_3$CO—).

(Polymerization Initiator)

A polymerization initiator is used in a process of manufacturing the curable resin (the resin binder) which is obtained by performing a polymerization reaction with respect to the multifunctional radical polymerizable compound described above. The polymerization initiator is a radical polymerization initiator which initiates a polymerization reaction of the multifunctional radical polymerizable compound, and examples of the polymerization initiator include a thermal polymerization initiator, a photopolymerization initiator, or the like.

A method of using an electron ray cleavage reaction, a method of using light or heat in the presence of the radical polymerization initiator, or the like can be adopted as a method of performing the polymerization reaction with respect to the multifunctional radical polymerizable compound.

Examples of the thermal polymerization initiator include an azo compound such as 2,2'-azobisisobutyronitrile, 2,2'-azobis(2,4-dimethyl azobisvaleronyl), and 2,2'-azobis(2-methyl butyronitrile); a peroxide such as benzoyl peroxide (BPO), di-tert-butyl hydroperoxide, tert-butyl hydroperoxide, chlorobenzoyl peroxide, dichlorobenzoyl peroxide, bromomethyl benzoyl peroxide, and lauroyl peroxide, and the like.

Examples of the photopolymerization initiator include an acetophenone-based initiator or a ketal-based photopolymerization initiator such as diethoxy acetophenone, 2,2-dimethoxy-1,2-diphenyl ethan-1-one, 1-hydroxy-cyclohexyl-phenyl-ketone, 4-(2-hydroxy ethoxy) phenyl-(2-hydroxy-2-propyl) ketone, 2-benzyl-2-dimethyl amino-1-(4-morpholinophenyl) butanone-1 ("Irgacure 369" (manufactured by BASF SE)), 2-hydroxy-2-methyl-1-phenyl propan-1-one, 2-methyl-2-morpholino(4-methyl thiophenyl) propan-1-one, and 1-phenyl-1,2-propane dione-2-(o-ethoxy carbonyl) oxime; a benzoin ether-based photopolymerization initiator such as benzoin, benzoin methyl ether, benzoin ethyl ether, benzoin isobutyl ether, and benzoin isopropyl ether; a benzophenone-based photopolymerization initiator such as benzophenone, 4-hydroxy benzophenone, o-benzoyl benzoic acid methyl, 2-benzoyl naphthalene, 4-benzoyl biphenyl, 4-benzoyl phenyl ether, acrylated benzophenone, and 1,4-benzoyl benzene; a thioxanthone-based photopolymerization initiator such as 2-isopropyl thioxanthone, 2-chlorothioxanthone, 2,4-dimethyl thioxanthone, 2,4-diethyl thioxanthone, 2,4-dichlorothioxanthone, and the like.

Examples of other photopolymerization initiators include ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl) phenyl phosphine oxide ("Irgacure 819" (manufactured by BASF SE)), bis(2,4-dimethoxy benzoyl)-2,4,4-trimethyl pentyl phosphine oxide, methyl phenyl glyoxyester, 9,10-phenanthrene, an acridine-based compound, a triazine-based compound, an imidazole-based compound, and the like. In addition, a photopolymerization initiator having an effect of accelerating a photopolymerization can be independently used, or can be used together with the photopolymerization initiators described above. Examples of the photopolymerization initiator having the effect of accelerating a photopolymerization include triethanol amine, methyl diethanol amine, 4-dimethyl aminobenzoic acid ethyl, 4-dimethyl aminobenzoic acid isoamyl, benzoic acid (2-dimethyl amino)ethyl, 4,4'-dimethyl aminobenzophenone, and the like.

It is preferable that a photopolymerization initiator is used as the polymerization initiator, it is more preferable that an alkyl phenone-based compound and a phosphine oxide-based compound are used as the polymerization initiator, and it is even more preferable that a photopolymerization initiator having an α-hydroxy acetophenone structure or an acyl phosphine oxide structure is used as the polymerization initiator.

One type of such polymerization initiators may be independently used, or two or more types thereof may be used by being mixed.

A used ratio of the polymerization initiator is 0.1 part by mass to 40 parts by mass, and is preferably 0.5 part by mass to 20 parts by mass, with respect to 100 parts by mass of the multifunctional radical polymerizable compound.

The outermost surface layer of the photoreceptor according to the embodiment of the present invention may contain an electric charge transport agent, organic fine particles, lubricant particles, an antioxidation agent, and the like, in addition to the composite structure particles and the resin binder as described above, as necessary.

(Electric Charge Transport Agent)

The electric charge transport agent (an electric charge transport compound) is not particularly limited insofar as having charge transport performance of transporting electric charge carriers in the outermost surface layer, and for example, compounds represented by General Formula (1) described below may be contained as the electric charge transport agent. Furthermore, the electric charge transport agent (the electric charge transport compound) used in the embodiment of the present invention does not react with the composite structure particles.

[Chemical Formula 4]

(1)

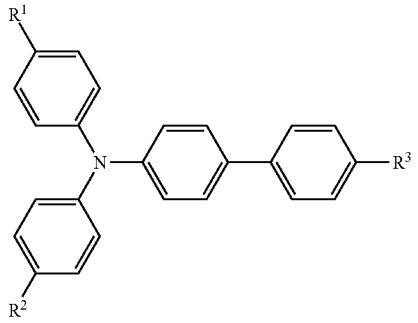

In General Formula (1) described above, $R^1$ and $R^2$ are each independently a hydrogen atom or a methyl group, and a methyl group is preferable. In addition, $R^3$ is a linear or branch alkyl group having 1 to 5 carbon atoms, and a linear or branch alkyl group having 2 to 4 carbon atoms is preferable.

The compounds represented by General Formula (1) described above are the electric charge transport compound transporting the electric charge carriers in the outermost surface layer. In the compounds, absorption does not occurs in a short wavelength range, the molecular weight is generally less than or equal to 450 (preferably, greater than or equal to 320 and less than or equal to 420), and the compound is capable of being inserted into a void of a resin component (the resin binder or the like) in the outermost surface layer. For this reason, it is possible to smoothly inject the electric charge carriers from the electric charge transport layer without decreasing the abrasion resistance of the outermost surface layer, and it is possible to transport the electric charges onto the surface of the outermost surface layer without causing an increase in a residual electric potential or the generation of the image memory.

In General Formula (1) described above, $R^1$ and $R^2$ are each independently a hydrogen atom or a methyl group, and it is preferable that $R^1$ and $R^2$ are different from each other from the viewpoint of manufacturing stability.

In addition, in General Formula (1) described above, examples of the linear or branch alkyl group having 1 to 5 carbon atoms used in $R^3$ include a methyl group, an ethyl group, a propyl group, an isopropyl group, an n-butyl group, an isobutyl group, a tert-butyl group, an n-pentyl group, an isopentyl group, a neopentyl group, a tert-pentyl group, a 2-methyl butyl group, and the like. Among them, the propyl group, the n-butyl group, and the n-pentyl group are preferable from the viewpoint of solubility.

Specific examples of the compounds represented by General Formula (1) described above are as follows.

[Chemical Formula 5]

CTM-1

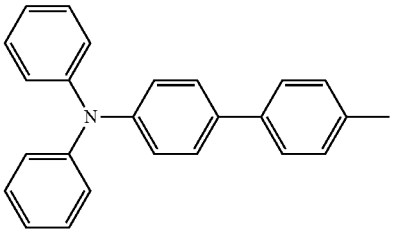

(Molecular Weight: 321.43)

CTM-2

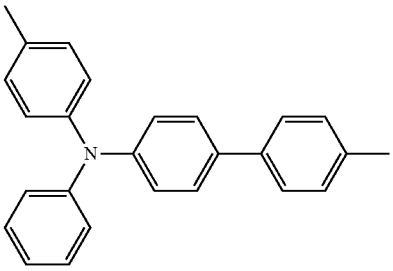

(Molecular Weight: 349.48)

CTM-3

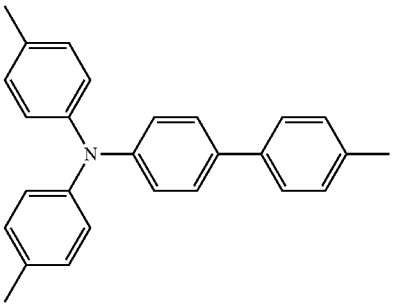

(Molecular Weight: 363.51)

CTM-4

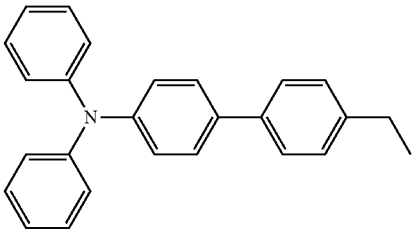

(Molecular Weight: 349.48)

-continued
CTM-5
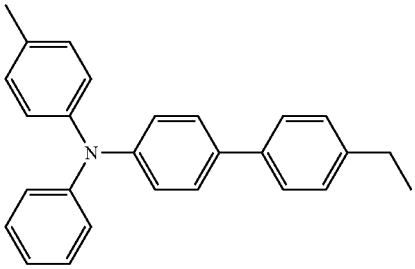
(Molecular Weight: 363.51)
CTM-6
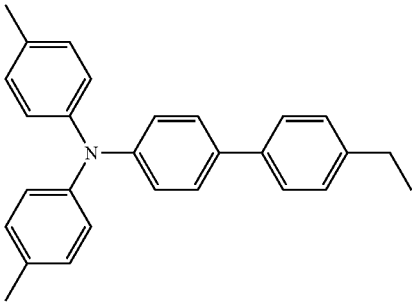
(Molecular Weight: 377.53)
CTM-7
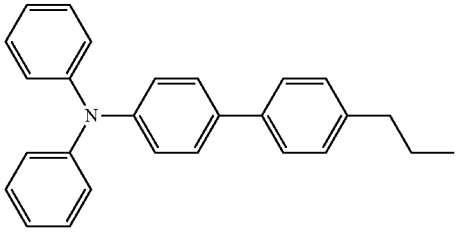
(Molecular Weight: 363.51)
CTM-8
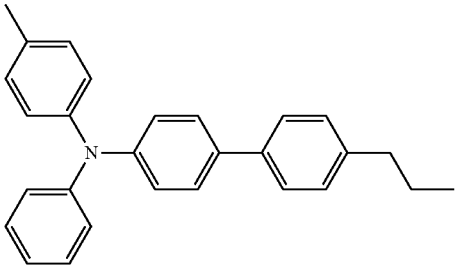
(Molecular Weight: 377.53)
[Chemical Formula 6]
CTM-9
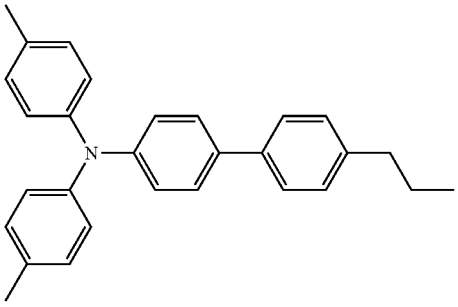
(Molecular Weight: 391.56)
-continued
CTM-10
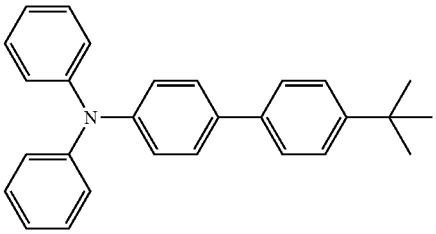
(Molecular Weight: 377.53)
CTM-11
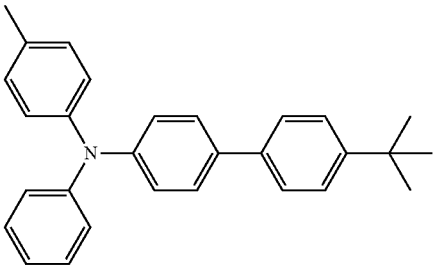
(Molecular Weight: 391.56)
CTM-12
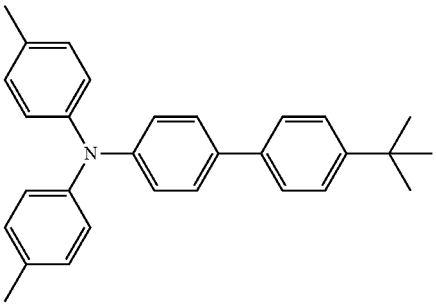
(Molecular Weight: 405.59)
CTM-13
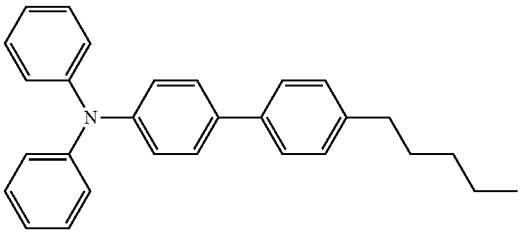
(Molecular Weight: 391.56)
CTM-14
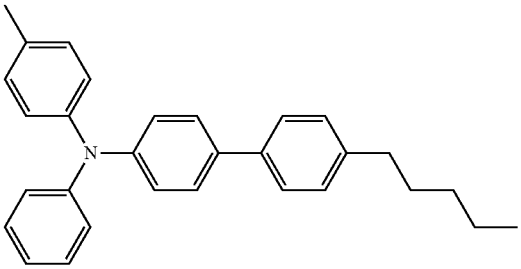
(Molecular Weight: 405.59)

-continued

CTM-15

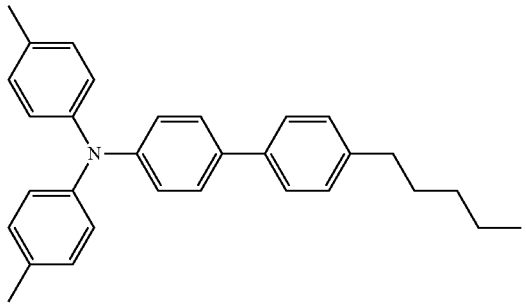

(Molecular Weight: 419.62)

A commercially available product may be used, or a synthetic product may be used, as the electric charge transport agent (the electric charge transport compound) described above. A known synthetic method can be used as a synthetic method of the electric charge transport agent (the electric charge transport compound) of the compounds represented by General Formula (1) described above, and examples of the synthetic method include a synthetic method described in JP 2006-143720 A. In addition, the electric charge transport agents (the electric charge transport compounds) described above can be independently used, or two or more types thereof can be used in combination.

In addition, it is preferable that the electric charge transport agent (the electric charge transport compound) in the outermost surface layer of the photoreceptor is contained at a ratio of 10 parts by mass to 30 parts by mass, and it is more preferable that the electric charge transport agent (the electric charge transport compound) is contained at a ratio of 15 parts by mass to 25 parts by mass, with respect to 100 parts by mass of the resin binder (the polymerized cured substance). By setting a content ratio of the electric charge transport agent (the electric charge transport compound) to be within the range described above, it is possible to more efficiently obtain the effect according to the embodiment of the present invention. Further, it is possible to sufficiently suppress the generation of image deletion.

(Organic Fine Particles)

The outermost surface layer of the photoreceptor, for example, may contain resin particles having a configuration unit derived from at least one type of melamine and benzoguanamine, styrene-acrylic resin particles, polystyrene resin particles, silicone resin particles, or the like as the organic fine particles. One type of the particles may be independently used, or two or more types thereof may be used together.

Examples of a resin having a configuration unit derived from at least one type melamine and benzoguanamine described above, specifically include a melamine resin such as a polycondensation of melamine and formaldehyde, and a copolycondensation of melamine, benzoguanamine, and formaldehyde; a benzoguanamine resin such as a polycondensation of benzoguanamine and formaldehyde, and the like. Among them, organic fine particles formed of the polycondensation of melamine and formaldehyde are preferable from the viewpoint of toner cleaning properties and of suppressing unevenness in an image concentration.

A number average primary particle diameter of the organic fine particles is preferably in a range of 0.01 μm to 5.00 μm, and is even more preferably in a range of 0.10 μm to 3.50 μm. According to such a range, the organic fine particles are exposed onto the surface of the outermost surface layer at the time of forming the outermost surface layer, and a rubbing force with respect to the toner at the time of developing increases, and thus, it is possible to suppress a decrease in a surface electric potential of the photoreceptor. In addition, it is possible to suitably roughen the surface of the photoreceptor, and to ensure excellent cleaning properties.

(Measurement Method of Number Average Primary Particle Diameter)

The number average primary particle diameter of the organic fine particles can be measured as follows.

The organic fine particles described above are photographed in magnification of 10000 times at an acceleration voltage of 80 kV by a transmissive electronic microscope "JEM-2000FX" (manufactured by JEOL Ltd.), a photograph image is captured by a scanner, the organic fine particles of the photograph image are subjected to a binarization treatment by using an image treatment analysis device "LUZEX (Registered Trademark) AP" (manufactured by NIRECO CORPORATION), Feret diameters of 100 organic fine particles in a horizontal direction are calculated, and an average value thereof is set to the number average primary particle diameter. Here, the Feret diameter in the horizontal direction represents a length of a side of a circumscribed rectangle, which is parallel to an x axis at the time of performing the binarization treatment with respect to the images of the organic fine particles.

It is preferable that the content of the organic fine particles described above is in a range of 5 parts by mass to 100 parts by mass with respect to 100 parts by mass of the resin binder (the polymerized cured substance) since an effect of suppressing toner scattering, and an effect of reducing fogging. In addition, it is preferable from the viewpoint of improving the abrasion resistance of the outermost surface layer.

The outermost surface layer of the photoreceptor according to the embodiment of the present invention is capable of further containing various antioxidation agents or lubricant particles. Examples of the lubricant particles include fluorine atom-containing resin particles, and specific examples thereof include ethylene tetrafluoride resin particles, ethylene trifluoride chloride resin particles, propylene hexafluoride-ethylene chloride copolymer resin particles, vinyl fluoride resin particles, vinylidene fluoride resin particles, ethylene difluoride dichloride resin particles, and one type or two or more types of copolymer particles thereof. Among them, the ethylene tetrafluoride resin particles or the vinylidene fluoride resin particles are preferable.

<Forming Method of Outermost Surface Layer of Photoreceptor>

The outermost surface layer of the photoreceptor according to the embodiment of the present invention can be formed by preparing a coating liquid (coating liquid for an outermost surface layer) in which the composite structure particles, and as necessary, the polymerizable compound (a raw material of the curable resin, which is the resin binder), the polymerization initiator, the electric charge transport agent, the organic fine particles, and the like are mixed in a solvent, and by applying the coating liquid onto the electric charge transport layer described below, and then, by drying and curing the coating liquid.

In the process of coating, drying, and curing described above, a reaction between the polymerizable compounds, a reaction between the polymerizable compound and a hydroxyl group (a reactive group) of the composite structure particles or a polymerizable reactive group of the composite structure particles subjected to the surface treatment with the surface treatment agent, a reaction between the composite structure particles subjected to the surface treatment, and the like are performed, and thus, the outermost surface layer is formed.

Any solvent can be used as the solvent used in the coating liquid for an outermost surface layer insofar as the solvent is capable of dissolving or dispersing the composite structure particles, and the polymerizable compound (the raw material of the curable resin, which is the resin binder), the polymerization initiator, the electric charge transport agent, the organic fine particles, and the like to be added as necessary. Specifically, examples of the solvent include methanol, ethanol, n-propyl alcohol, isopropyl alcohol, n-butyl alcohol, t-butyl alcohol, sec-butyl alcohol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolan, pyridine, diethyl amine, and the like, but are not limited thereto. One type of such solvents can be independently used, or two or more types thereof can be used in combination.

A manufacturing method of the coating liquid is not also particularly limited, and the composite structure particles, and as necessary, various additive agents such as the polymerizable compound (the raw material of the curable resin which is the resin binder), the polymerization initiator, the electric charge transport agent, and the organic fine particles may be added to the solvent, and may be stirred and mixed until being dissolved or dispersed. In addition, the amount of solvent is not also particularly limited, and may be suitably adjust such that the viscosity of the coating liquid is suitable for a coating operation.

A coating method is not particularly limited, and for example, a known method such as an immersion coating method, a spray coating method, a spinner coating method, a beads coating method, a blade coating method, a beam coating method, a slide hopper method, and a circular slide hopper method can be used.

The coating liquid described above is applied, and then, natural drying or thermal drying is performed, and a coated film is formed, and then, in the case of using the polymerizable compound, curing is performed by applying an active energy ray, and thus, a resin component containing the polymerizable compound (the surface treatment agent or the fluorine resin used for the surface treatment of the composite structure particles) as a monomer component is generated. An ultraviolet ray or an electron ray is more preferable, and the ultraviolet ray is even more preferable, as the active energy ray.

Any ultraviolet ray light source can be used without any limitation insofar as the ultraviolet ray light source is a light source generating an ultraviolet ray. For example, a low pressure mercury lamp, a medium pressure mercury lamp, a high pressure mercury lamp, an ultrahigh pressure mercury lamp, a carbon arc lamp, a metal halide lamp, a xenon lamp, a flash (pulse) xenon lamp, and the like can be used. An irradiation condition is different according to each of the lamps, and the irradiation dose of the ultraviolet ray is generally 5 $mJ/cm^2$ to 500 $mJ/cm^2$, and is preferably 5 $mJ/cm^2$ to 100 $mJ/cm^2$. The output of the light source is preferably 0.1 kW to 5 kW, and is more preferably 0.5 kW to 3 kW.

The electron ray irradiate device used as the electron radiation source is not particularly limited, and in general, a device of a curtain beam system which is comparatively inexpensive and is capable of a large output is preferably used as an electron ray accelerator for applying an electron ray. It is preferable that an acceleration voltage at the time of irradiation with an electron ray is 100 kV to 300 kV. It is preferable that the absorbed dose is 0.5 Mrad to 10 Mrad.

Irradiation time for obtaining required irradiation dose of the active energy ray is preferably 0.1 seconds to 10 minutes, and is more preferably 0.1 seconds to 5 minutes from the viewpoint of an operation efficiency.

In the process of forming the outermost surface layer of the photoreceptor, drying can be performed before and after the active energy ray is applied or while the active energy ray is applied, and a timing of performing the drying can be suitably selected by combining the aspects of the applying the active energy ray.

The condition of the drying can be suitably selected according to the type of solvent, a film thickness, and the like. A drying temperature is preferably 20° C. to 180° C., and is more preferably 80° C. to 140° C. Drying time is preferably 1 minute to 200 minutes, and is more preferably 5 minutes to 100 minutes.

A film thickness of the outermost surface layer of the photoreceptor is preferably 1 μm to 10 μm, and is more preferably 1.5 μm to 5 μm.

[Configuration of Photoreceptor]

Hereinafter, the configuration of the electrophotographic photoreceptor other than the outermost surface layer of photoreceptor will be described.

In the embodiment of the present invention, the electrophotographic photoreceptor is an electrophotographic photoreceptor configured by allowing an organic compound or the like to have at least one function of a charge generating function and a charge transport function requisite for the configuration of the electrophotographic photoreceptor, and includes all known photoreceptors such as a photoreceptor configured of a known organic electric charge generating substance or a known organic electric charge transport substance, and a photoreceptor in which a polymer complex has a charge generating function and a charge transport function.

The photoreceptor according to the embodiment of the present invention has a layer configuration in which the electric charge generating layer and the electric charge transport layer are laminated on a conductive support body as a photosensitive layer, and the outermost surface layer is laminated on an upper portion of the photosensitive layer, sequentially. In addition, it is preferable that an intermediate layer is provided between the conductive support body and the electric charge generating layer.

A configuration other than the surface layer of the photoreceptor according to the embodiment of the present invention will be described focused on the layer configuration described above.

<Conductive Support Body>

The conductive support body used in the embodiment of the present invention may be any conductive support body insofar as having conductivity. Specific examples of the conductive support body include a conductive support body in which a metal such as aluminum, copper, chromium, nickel, zinc, or stainless steel is formed into the shape of a drum (a cylinder) or a sheet, a conductive support body in which a metal foil of aluminum or copper is laminated on a plastic film, a conductive support body in which a plastic film of aluminum, indium oxide, tin oxide, or the like is subjected to vapor deposition, a metal, a plastic film, or a sheet on which a conductive substance is independently applied or is applied along with a binder resin, and a conductive film is disposed, and the like.

<Intermediate Layer>

In the embodiment of the present invention, it is possible to dispose the intermediate layer having a barrier function and an adhesive function between the conductive support body and the photosensitive layer. In consideration of preventing various failures or the like, it is preferable to dispose the intermediate layer.

Such an intermediate layer, for example, contains a binder resin, and as necessary, conductive particles or metal oxide particles.

The binder resin which can be used in the conductive support body and the intermediate layer described above is not particularly limited, and a binder resin for a known conductive support body of the related art or a binder resin for a known intermediate layer of the related art can be used as the binder resin. Examples of the binder resin include casein, polyvinyl alcohol, nitrocellulose, an ethylene-acrylic acid copolymer, a polyamide resin, a polyurethane resin, gelatin, and the like. Among them, an alcohol-soluble polyamide resin is preferable. One type of such binder resins can be independently used, or two or more types thereof can be used in combination.

The intermediate layer is capable of containing various conductive particles or metal oxide particles in order to adjust the resistance. For example, various metal oxide particles of alumina, zinc oxide, titanium oxide, tin oxide, antimony oxide, indium oxide, bismuth oxide, and the like can be used. Further, various conductive particles (ultrafine particles) of indium oxide doped with tin (ITO), tin oxide doped with antimony (ATO), zirconium oxide, and the like can be used. One type of various conductive particles or metal oxide particles used for adjusting the resistance, may be independently used, or two or more types thereof may be used by being mixed. In a case of mixing two or more types of the conductive particles or the metal oxide particles, the form of a solid solution or fusion may be adopted.

A number average primary particle diameter of various conductive particles or metal oxide particles used for adjusting the resistance is preferably less than or equal to 0.3 μm, and is more preferably less than or equal to 0.1 μm.

A content ratio (the total amount) of the conductive particles and/or the metal oxide particles described above is preferably 20 parts by mass to 400 parts by mass, is more preferably 50 parts by mass to 350 parts by mass, and is even more preferably 50 parts by mass to 200 parts by mass, with respect to 100 parts by mass of the binder resin in the intermediate layer, from the viewpoint of adjusting the resistance.

A film thickness of the intermediate layer is preferably 0.1 μm to 15 μm, and is more preferably 0.3 μm to 10 μm, from the viewpoint of adjusting the resistance.

For example, a coating liquid for forming an intermediate layer is prepared by dissolving the binder resin in a known solvent, and as necessary, by dispersing the conductive particles or the metal oxide particles, a coating film is formed by applying the coating liquid for forming an intermediate layer onto the surface of the conductive support body, and the coating film is dried, and thus, the intermediate layer as described above can be formed.

The solvent used in the coating liquid for forming an intermediate layer described above is not particularly limited, and for example, n-butyl amine, diethyl amine, ethylene diamine, isopropanol amine, triethanol amine, triethylene diamine, N,N-dimethyl formamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide, methyl cellosolve, and the like can be used, and among them, toluene, tetrahydrofuran, dioxolan, and the like are preferably used. One type of such solvents can be independently used, or a mixed solvent of two or more types thereof can be used. Among them, a solvent is preferable in which the conductive particles or the metal oxide particles as described above are excellently dispersed, and the binder resin, in particular, the polyamide resin is dissolved. Specifically, alcohols having 1 to 4 carbon atoms such as methanol, ethanol, n-propyl alcohol, isopropyl alcohol, n-butyl alcohol, t-butyl alcohol, and sec-butyl alcohol, are preferable since the solubility of the polyamide resin and coating performance are excellent. One type of such solvents can be independently used, or two or more types thereof can be used in combination. In addition, in order to improve preservability and dispersibility of the inorganic particles, the solvent described above and an auxiliary solvent can be used together. Examples of the auxiliary solvent from which a preferred effect is obtained, include benzyl alcohol, toluene, methylene chloride, cyclohexanone, tetrahydrofuran, and the like.

The concentration of the binder resin in the coating liquid for forming an intermediate layer described above is suitably selected according to the film thickness of the intermediate layer or a production rate.

An ultrasonic wave disperser, a ball mill, a sand grinder, a homomixer, and the like can be used as a disperser of the conductive particles or the metal oxide particles described above.

A coating method of the coating liquid for forming an intermediate layer is not particularly limited, and examples of the coating method include an immersion coating method, a spray coating method, and the like.

A known drying method can be suitably selected as a drying method of the coating film according to the type of solvent or the film thickness of the intermediate layer to be formed, and in particular, thermal drying is preferable.

As described above, a method of forming the intermediate layer is not particularly limited, and the coating liquid for forming an intermediate layer is prepared in which the binder resin is dissolved in the solvent described above, and as necessary, the conductive particles or the metal oxide particles are dispersed by using a device (a disperser) such as an ultrasonic wave disperser, a ball mill, a sand mill, or a homomixer, and then, the coating liquid for forming an intermediate layer is applied onto the conductive support body with a desired thickness. After that, the coated layer is dried, and thus, the intermediate layer can be completed.

<Photosensitive Layer>

The photoreceptor according to the embodiment of the present invention includes the photosensitive layer, and the photosensitive layer includes the electric charge generating layer and the electric charge transport layer. Specifically, the electric charge generating layer and the electric charge transport layer are laminated in this order from the conductive support body side.

<<Electric Charge Generating Layer>>

It is preferable that the electric charge generating layer used in the photoreceptor according to the embodiment of the present invention contains an electric charge generating substance and a binder resin (hereinafter, also referred to as a binder resin for an electric charge generating layer).

Examples of the electric charge generating substance include an azo raw material such as sudan red and diane blue, pyrene quinone, a quinone pigment such as antoantron, a quinocyanine pigment, a perylene pigment, an indigo pigment such as indigo and thioindigo, a polycyclic quinone pigment such as pyranthrone and diphthaloyl pyrene, a phthalocyanine pigment such as a titanyl phthalocyanine pigment, and the like, but are not limited thereto. One type of such electric charge generating substances can be independently used, or two or more types thereof can be used in combination. Among them, the polycyclic quinone pigment and the titanyl phthalocyanine pigment are preferable.

The binder resin for an electric charge generating layer is not particularly limited, and a known resin can be used. Specific example of the binder resin for an electric charge generating layer include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenolic resin, a polyester resin, an alkyd resin, a polycarbonate resin, a silicone resin, a melamine resin, a copolymer resin containing two or more of the resins (for example, a vinyl chloride-vinyl acetate copolymer resin and a vinyl chloride-vinyl acetate-maleic acid anhydride copolymer resin), a polyvinyl carbazole resin, and the like, but are not limited thereto. One type of such binder resins can be independently used, or two or more types thereof can be used in combination. The polyvinyl butyral resin is preferable.

A content ratio of the electric charge generating substance in the electric charge generating layer is preferably 1 part by mass to 600 parts by mass, is more preferably 20 parts by mass to 600 parts by mass, and is even more preferably 50 parts by mass to 500 parts by mass, with respect to 100 parts by mass of the binder resin for an electric charge generating layer, from the viewpoint of enabling an increase in the residual electric potential according to repeated use to be extremely suppressed by suppressing a decrease in the electric resistance of the photoreceptor to be low.

A film thickness of the electric charge generating layer is different according to the properties of the electric charge generating substance, the properties of the binder resin for an electric charge generating layer, the content ratio, or the like, but is preferably 0.01 μm to 5 μm, is more preferably 0.05 μm to 3 μm, is even more preferably 0.1 μm to 2 μm, and still more preferably 0.15 μm to 1.5 μm.

A forming method of the electric charge generating layer as described above is not particularly limited, and for example, a coating liquid for forming an electric charge generating layer is prepared in which the electric charge generating substance is added into a solution where the binder resin for an electric charge generating layer is dissolved in a known solvent, and is dispersed by using a disperser. A coating film is formed by applying the coating liquid for forming an electric charge generating layer onto the surface of the conductive support body, and in the case of a configuration where the intermediate layer is disposed on the conductive support body, by applying the coating liquid for forming an electric charge generating layer onto the surface of the intermediate layer (with a constant film thickness by using a coater), and the coating film is dried, and thus, the electric charge generating layer can be formed. The same methods as the methods exemplified in the section of the surface layer described above can be adopted as a coating method and a drying method. Furthermore, a coating liquid for an electric charge generating layer is capable of preventing an image defect from occurring by filtering foreign substances or agglomerated substances before being applied. In addition, the electric charge generating substance described above may be independently and directly added into the solution described above, or may be added in an aspect of being dispersed in the binder resin for an electric charge generating layer described above. In addition, the electric charge generating layer can be formed by performing vacuum vapor deposition with respect to the electric charge generating substance. In such an aspect, the binder resin for an electric charge generating layer may not be particularly used.

A mixed ratio of the binder resin for an electric charge generating layer and the electric charge generating substance in the coating liquid for forming an electric charge generating layer is electric charge generating substance preferably 1 part by mass to 600 parts by mass, is more preferably 20 parts by mass to 600 parts by mass, and is even more preferably 50 parts by mass to 500 parts by mass, with respect to 100 parts by mass of the binder resin for an electric charge generating layer. Setting the mixed ratio of the binder resin for an electric charge generating layer and the electric charge generating substance to be in the range described above is excellent from the viewpoint of enabling the coating liquid for forming an electric charge generating layer to have high dispersion stability, and an increase in the residual electric potential according to repeated use to be extremely suppressed by suppressing the electric resistance in the formed photoreceptor to be low.

A solvent which is capable of dissolving the binder resin for an electric charge generating layer may be used as the solvent used in the coating liquid for forming an electric charge generating layer, and example of the solvent are capable of including a ketone-based solvent such as methyl ethyl ketone, methyl isopropyl ketone, methyl isobutyl ketone, cyclohexanone, and acetophenone, an ether-based solvent such as tetrahydrofuran, dioxane, dioxolan, and diglyme, an alcohol-based solvent such as methyl cellosolve, 4-methoxy-4-methyl-2-pentanone, ethyl cellosolve, methanol, ethanol, n-propyl alcohol, isopropyl alcohol, n-butyl alcohol, t-butyl alcohol, sec-butyl alcohol, and butanol, an ester-based solvent such as ethyl acetate and t-butyl acetate, an aromatic solvent such as toluene, xylene, methylene chloride, and chlorobenzene, a halogen-based solvent such as dichloroethane and trichloroethane, cyclohexane, pyridine, diethyl amine, and the like, but are not limited thereto. One type of such solvents can be independently used, or two or more types thereof can be used by being mixed.

Examples of the disperser of the electric charge generating substance include an ultrasonic wave disperser, a ball mill, a sand mill, a homomixer, and the like, as with the disperser of the conductive particles or the metal oxide particles in the coating liquid for forming an intermediate layer, but are not limited thereto.

In addition, examples of a coating method of the coating liquid for forming an electric charge generating layer and a drying method of the coating film are capable of including the same methods as the methods described as the coating method of the coating liquid for forming an intermediate layer and the drying method of the coating film.

(Electric Charge Transport Layer)

It is preferable that the electric charge transport layer used in the photoreceptor according to the embodiment of the present invention contains an electric charge transport substance and a binder resin (hereinafter, also referred to as a binder resin for an electric charge transport layer).

The electric charge transport substance of the electric charge transport layer is a substance transporting electric charges, and examples of the electric charge transport substance include a triphenyl amine derivative, a hydrazone compound, a styryl compound, a benzidine compound, a butadiene compound, and the like, but are not limited thereto. One type of the electric charge transport substances can be independently used, or two or more types thereof can be used in combination. In addition, a commercially available product may be used, or a synthetic product may be used, as the electric charge transport substance described above. Examples of a synthetic method of the electric charge transport substance include a synthetic method of an electric charge transport substance (an electric charge transport compound) described in JP 2010-26428 A and JP 2010-91707 A.

The binder resin for an electric charge transport layer is not particularly limited, and a known resin can be used. Specific examples of the binder resin for an electric charge transport layer include a polycarbonate resin, a polyacrylate resin, a polyester resin, a polystyrene resin, a styrene-acrylonitrile copolymer resin, polymethacrylic acid ester resin, a styrene-methacrylic acid ester copolymer resin, and the like, and the polycarbonate resin is preferable. One type of the binder resin for an electric charge transport layers can be independently used, or two or more types thereof can be used in combination. Polycarbonate A containing bisphenol A (BPA) as a monomer component, polycarbonate Z containing 1,1-bis(4-hydroxy phenyl) cyclohexane (bisphenol Z, BPZ) as a monomer component, a polycarbonate resin containing dimethyl bisphenol A (dimethyl BPA) as a monomer component, a polycarbonate resin containing BPA and dimethyl BPA as a monomer component, and the like are more preferable from the viewpoint of crack resistance, wear resistance, and charging properties.

A content ratio of the electric charge transport substance in the electric charge transport layer is preferably 10 parts by mass to 500 parts by mass, and is more preferably 20 parts by mass to 250 parts by mass, with respect to 100 parts by mass of the binder resin for an electric charge transport layer, from the viewpoint of enabling an increase in the residual electric potential to be extremely suppressed according to repeated use by suppressing the electric resistance in the photoreceptor to be low.

An antioxidation agent, an electron conductive agent, a stabilizer, silicone oil, and the like may be further added to the electric charge transport layer. For example, an antioxidation agent disclosed in JP 2000-305291 A is preferable as the antioxidation agent, and an electron conductive agent disclosed in JP 50-137543 A, JP 58-76483 A, and the like is preferable as the electron conductive agent.

A layer thickness of the electric charge transport layer is different according to the properties of the electric charge transport substance, the properties of the binder resin for an electric charge transport layer, the content ratio, and the like, but is preferably 5 μm to 40 μm, and is more preferably 10 μm to 30 μm.

A forming method of the electric charge transport layer as described above is not particularly limited, and for example, a coating liquid for forming an electric charge transport layer is prepared in which an electric charge transport substance (CTM) is added to a solution where the binder resin for an electric charge transport layer is dissolved in a known solvent, and is dispersed by using a disperser. A coating film is formed by applying the coating liquid for forming an electric charge transport layer onto the surface of the electric charge generating layer (with a constant film thickness by using a coater), and the coating film is dried, and thus, the electric charge transport layer can be formed. The same method as the method exemplified in the section of the outermost surface layer described above can be adopted as a coating method. The same methods as the methods exemplified in the section of the surface layer described above can be adopted as a coating method and a drying method. Furthermore, a coating liquid for an electric charge transport layer is capable of preventing an image defect from occurring by filtering foreign substances or agglomerated substances before being applied. In addition, the electric charge transport substance described above may be directly independently added into the solution described above, or may be added in an aspect of being dispersed in the binder resin for an electric charge transport layer described above. In addition, the electric charge transport layer can be formed by performing vacuum vapor deposition with respect to the electric charge transport substance. In such an aspect, the binder resin for an electric charge transport layer may not be particularly used.

Examples of the solvent used in the coating liquid for an electric charge transport layer are capable of including the same solvent as that used in the coating liquid for an electric charge generating layer.

In addition, examples of a coating method of the coating liquid for forming an electric charge transport layer and a drying method of the coating film are capable of including the same methods as the methods described as the coating method of the coating liquid for forming an electric charge generating layer and the drying method of the coating film.

A mixed ratio of the electric charge transport substance to the binder resin for an electric charge transport layer in the coating liquid for an electric charge transport layer is preferably 10 parts by mass to 500 parts by mass, and is more preferably 20 parts by mass to 250 parts by mass, with respect to 100 parts by mass of the binder resin for an electric charge transport layer. Setting the mixed ratio of the binder resin for an electric charge transport layer and the electric charge transport substance to be in the range described above is excellent from the viewpoint of enabling the coating liquid for forming an electric charge transport layer to have high dispersion stability, and an increase in the residual electric potential according to repeated use to be extremely suppressed by suppressing the electric resistance in the formed photoreceptor to be low.

[Charging Roller (Charger: Roller Charging System)]

Figure 3:
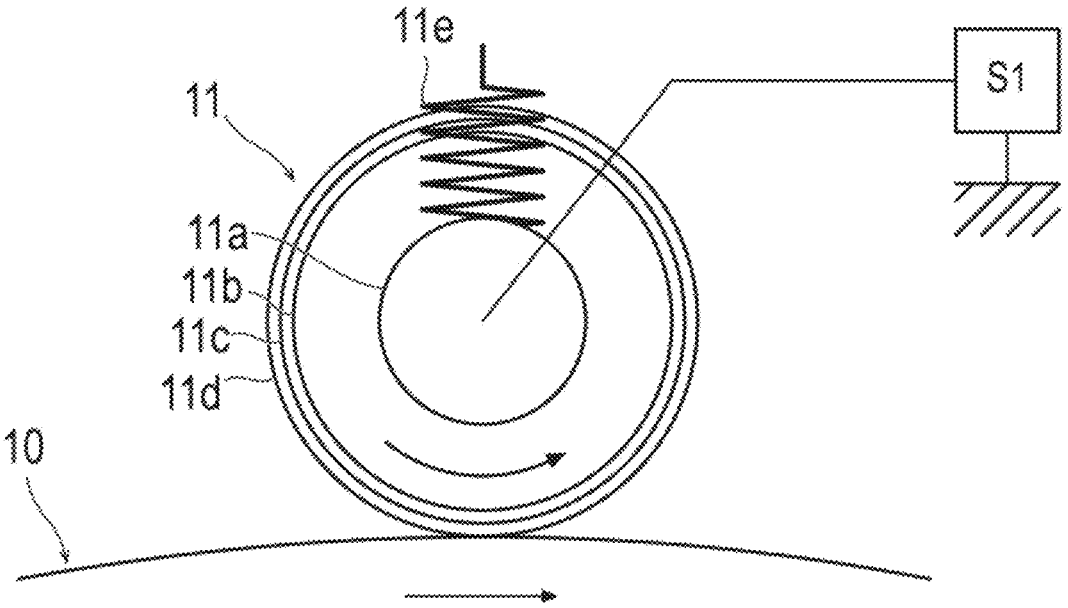
FIG. 3 is a sectional view for illustrating an example of a configuration of a charging roller in the image forming apparatus illustrated in FIG. 1.

The charging roller 11 is a roller for (negatively) charging the surface of the electrophotographic photoreceptor, and is the charger of the proximity charging system (including a contact system) (the roller charging system) for applying a charging voltage in proximity to (including an aspect of being in contact with) the surface of the electrophotographic photoreceptor. In a representative embodiment of the charging roller 11 including the charger (the roller charging system), for example, as illustrated in FIG. 3, a resistance control layer 11*c* for allowing the entire charging roller 11 to obtain high homogeneous electric resistance is laminated on a surface of an elastic layer 11*b* for obtaining homogeneous adhesiveness with respect to the photoreceptor 10 by reducing a charging and of applying elasticity, which is laminated on a surface of a cored bar 11*a*, as necessary, a surface layer 11*d* is laminated on the resistance control layer 11*c*, and a charging nip portion is formed by being crimped with respect to the surface of the photoreceptor 10 which is biased in the direction of the photoreceptor 10 by a pressing spring 11*e* with a predetermined pressing force, and thus, the charging roller 11 is rotated according to the rotation of the photoreceptor 10.

The cored bar 11*a*, for example, is formed of a metal such as iron, copper, stainless steel, aluminum, and nickel, or is formed by performing a plating treatment for obtaining rust preventing properties or scratch resistance with respect to the surface of such a metal within range not impairing conductivity, and an outer diameter of the cored bar 11*a*, for example, is 3 mm to 20 mm.

The elastic layer 11*b*, for example, is formed by adding conductive fine particles formed of carbon black, carbon graphite, or the like, or conductive salt fine particles formed of an alkali metal salt, an ammonium salt, or the like into an elastic material such as rubber. Specific examples of the elastic material are capable of including synthetic rubber such as natural rubber, ethylene propylene diene methylene rubber (EPDM), styrene-butadiene rubber (SBR), silicone rubber, urethane rubber, epichlorohydrin rubber, isoprene rubber (IR), butadiene rubber (BR), nitrile-butadiene rubber (NBR), and chloroprene rubber (CR), a resin such as a polyamide resin, a polyurethane resin, a silicone resin, and a fluorine resin, a foam such as a foamed sponge, or the like. The degree of elasticity can be adjusted by adding process oil, a plasticizing agent, and the like into the elastic material.

It is preferable that volume resistivity of the elastic layer 11*b* is in a range of $1\times10^{1}$ Ω·cm to $1\times10^{10}$ Ω·cm. In addition, a layer thickness of the elastic layer 11*b* is preferably in a range of 500 μm to 5000 μm, and is more preferably in a range of 500 μm to 3000 μm. The volume resistivity of the elastic layer 11*b* is a value measured on the basis of JIS K6911-2006.

The resistance control layer 11*c* is disposed in order to allow the entire charging roller 11 to have homogeneous electric resistance, but may not be disposed. The resistance control layer 11*c* can be disposed by applying a material having suitable conductivity or coating with a tube having suitable conductivity.

Examples of a specific material configuring the resistance control layer 11*c* include a material in which a conductive agent, such as conductive fine particles formed of carbon black, carbon graphite, and the like; conductive metal oxide fine particles formed of conductive titanium oxide, conductive zinc oxide, conductive tin oxide, and the like; and conductive salt fine particles formed of an alkali metal salt, an ammonium salt, and the like, is added into a basic material, such as a resin such as a polyamide resin, a polyurethane resin, a fluorine resin, and a silicone resin; and rubbers such as epichlorohydrin rubber, urethane rubber, chloroprene rubber, and acrylonitrile-based rubber.

Volume resistivity of the resistance control layer 11*c* is preferably in a range of $1\times10^{-2}$ Ω·cm to $1\times10^{14}$ Ω·cm, and is more preferably in a range of $1\times10^{1}$ Ω·cm to $1\times10^{10}$ Ω·cm. In addition, a layer thickness of the resistance control layer 11*c* is preferably in a range of 0.5 μm to 100 μm, is more preferably in a range of 1 μm to 50 μm, and is even more preferably in a range of 1 μm to 20 μm. The volume resistivity of the resistance control layer 11*c* is a value measured on the basis of JIS K6911-2006.

The surface layer 11*d* is disposed in order to prevent the bleedout of a plasticizing agent or the like in the elastic layer 11*b* with respect to the surface of the charging roller 11 to be obtained, to obtain the slipperiness or the smoothness of the surface of the charging roller 11, or to prevent a leakage even in a case where there is a defect such as a pinhole, on the photoreceptor 10, and is disposed by applying a material having suitable conductivity or coating with a tube having suitable conductivity.

In a case where the surface layer 11*d* is disposed by applying a material, examples of a specific material include a material in which a conductive agent, such as conductive fine particles formed of carbon black, carbon graphite, and the like; and conductive metal oxide fine particles formed of conductive titanium oxide, conductive zinc oxide, conductive tin oxide, and the like, is added into a basic material, such as a resin such as a polyamide resin, a polyurethane resin, an acrylic resin, a fluorine resin, and a silicone resin, epichlorohydrin rubber, urethane rubber, chloroprene rubber, and acrylonitrile-based rubber. Examples of a coating method include an immersion coating method, a roll coating method, a spray coating method, and the like.

In addition, in a case where the surface layer 11*d* is disposed by coating with a tube, examples of a specific tube include a tube in which the conductive agent described above is added into nylon 12, an ethylene tetrafluoride-perfluoroalkyl vinyl ether copolymer resin (PFA), polyvinylidene fluoride, an ethylene tetrafluoride-propylene hexafluoride copolymer resin (FEP); thermoplastic elastomer such as a polystyrene-based thermoplastic elastomer, a polyolefin-based thermoplastic elastomer, a polyvinyl chloride-based thermoplastic elastomer, a polyurethane-based thermoplastic elastomer, a polyester-based thermoplastic elastomer, and a polyamide-based thermoplastic elastomer, and the like, and then, is molded into the shape of a tube. The tube may have thermal shrinkable properties, or may have non-thermal shrinkable properties.

Volume resistivity of the surface layer 11*d* is preferably in a range of $1\times10^{1}$ Ω·cm to $1\times10^{8}$ Ω·cm, and is more preferably in a range of $1\times10^{1}$ Ω·cm to $1\times10^{5}$ Ω·cm. In addition, a layer thickness of the surface layer 11*d* is preferably in a range of 0.5 μm to 100 μm, is more preferably in a range of 1 μm to 50 μm, and is even more preferably in a range of 1 μm to 20 μm. The volume resistivity of the surface layer 11*d* is a value measured on the basis of JIS K6911-2006.

In addition, surface roughness Rz of the surface layer 11*d* is preferably in a range of 1 μm to 30 μm, is more preferably in a range of 2 μm to 20 μm, and is even more preferably in a range of 5 μm to 10 μm. The surface roughness Rz of the surface layer 11*d* is a value measured on the basis of JIS B0601-2001.

In the charging roller 11 as described above, a charging bias voltage is applied to the cored bar 11*a* of the charging roller 11 from a power source S1, and the surface of the photoreceptor 10 is charged to a predetermined electric potential of a predetermined polarity. Here, the charging bias voltage, for example, may be only a direct current voltage, and is preferably a vibration voltage in which an alternate current voltage is superimposed on a direct current voltage since charging homogeneousness is excellent. The charging bias voltage, for example, is capable of being approximately −2.5 kV to −1.5 kV.

In an example of a charging condition of the charging roller 11 illustrated in FIG. 3, a direct current voltage (Vdc) forming the charging bias voltage is −500 V, an alternate current voltage (Vac) is a sine wave at a frequency of 1000 Hz and a peak-to-peak voltage of 1300 V, and the charging bias voltage is applied, and thus, the surface of the photoreceptor 10 is homogeneously charged to −500 V.

The charging roller 11 has a length based on the length of the photoreceptor 10 in a longitudinal direction, and the length in the longitudinal direction, for example, is capable of being 320 mm.

In such an image forming apparatus, the photoreceptor 10 is rotationally driven, and the surface of the photoreceptor 10 is homogeneously charged to a predetermined electric potential by the charging roller 11 to which the charging bias voltage is applied from the power source S1.

Next, the photoreceptor 10 which is homogeneously charged is exposed by the exposurer 12, and thus, an electrostatic latent image is formed, and the electrostatic latent image is developed by the developer 13, and thus, a toner image is formed. The toner image formed on the photoreceptor 10 is transferred onto the transfer material P, which is transported according to a timing, by the transferer 14, is separated from the photoreceptor 10 with a separator (not illustrated), and is fixed by the fixer 17, and thus, a visible image is formed.

The toner or the like remaining on the photoreceptor 10 is removed by the cleaning blade 18*a* of the cleaner 18, and the removed toner or the like is stored in a reservoir 18*b*.

The image forming apparatus according to the embodiment of the present invention is not limited to an image forming apparatus having the configuration as described above, and may be a color image forming apparatus having a configuration in which image forming units according to a plurality of photoreceptors are arranged along intermediate transfer bodies.

In such a color image forming apparatus where the image forming units according to the plurality of photoreceptors are arranged, it is preferable that all of the plurality of photoreceptors are configured of the photoreceptor described above, and in a case where at least one of the plurality of photoreceptors is configured of the photoreceptor described above, it is possible to obtain an effect of suppressing the discharge degradation in the case of performing (negative) charging by the charger of the proximity charging system (at the time of roller charging), of allowing the photoreceptor to have high abrasion resistance, and of enabling an excellent image to be formed (high image stability is obtained in an image to be formed).

[Toner and Developing Agent]

The toner used in the image forming apparatus according to the embodiment of the present invention is a (negatively) charging toner. The toner used in the image forming apparatus according to the embodiment of the present invention may be a pulverization toner, or may be a polymerization toner, and in the image forming apparatus according to the embodiment of the present invention, it is preferable to use a polymerization toner prepared by a polymerization method from the viewpoint of obtaining an image having high image quality.

The polymerization toner represents a toner which is obtained by generating a binder resin forming the toner and by forming toner particles, along with a polymerization of a monomer of a raw material for obtaining the binder resin, and after that, as necessary, a chemical treatment.

More specifically, the polymerization toner represents a toner which is formed through a step of obtaining resin fine particles by a polymerization reaction such as a suspension polymerization and an emulsion polymerization, and after that, as necessary, a step of fusing the resin fine particles.

It is desirable that a volume average particle diameter of the toner, that is, a 50% volume particle diameter (Dv50) is 2 μm to 9 μm, and is more preferably 3 μm to 7 μm. According to such a range, it is possible to increase resolution. By further combining the range described above, it is possible to decrease an existence amount of a toner having a fine particle diameter in a state of a small particle diameter toner, to improve reproducibility of a dot image over a long period of time, and to form a stable image having excellent sharpness.

Only the toner according to the embodiment of the present invention may be used as a one-component developing agent, or the toner may be used as a two-component developing agent by being mixed with a carrier.

In a case of the one-component developing agent, examples of the one-component developing agent include a non-magnetic one-component developing agent, or a magnetic one-component developing agent in which magnetic particles of approximately 0.1 μm to 0.5 μm are contained in the toner, and both of the non-magnetic one-component developing agent and the magnetic one-component developing agent can be used.

In addition, in the case of using the two-component developing agent mixed with the carrier, a known material of the related art, such as a metal such as iron, ferrite, and magnetite, and an alloy of the metal and a metal such as aluminum and lead can be used as magnetic particles of the carrier. Ferrite particles are particularly preferable. A volume average particle diameter of the magnetic particles may be 15 μm to 100 μm, and may be more preferably 25 μm to 80 μm.

The volume average particle diameter of the toner or the carrier can be measured by a laser diffraction type particle size distribution measuring device "HELOS" (manufactured by Sympatec GmbH) representatively including a wet disperser.

A carrier in which the magnetic particles are further coated with a resin, or a carrier in which the magnetic particles are dispersed in a resin, a so-called resin dispersion carrier, is preferable as the carrier. A coating resin composition is not particularly limited, and for example, an olefin-based resin, a styrene-based resin, a styrene acrylic resin, a silicone-based resin, an ester-based resin, a fluorine-containing polymer-based resin, or the like is used. In addition, the resin for configuring the resin dispersion carrier is not particularly limited, but a known resin can be used, and for example, a styrene acrylic resin, a polyester resin, a fluorine-based resin, a phenolic resin, and the like can be used.

The embodiment of the present invention has been described in detail, but the embodiment of the present invention is not limited to the examples described above, and various modifications can be added.

EXAMPLES

Hereinafter, specific examples of the present invention will be described, but the present invention is not limited thereto.

[Preparation of Composite Structure Particles [1]]

As illustrated in FIG. 4A, barium sulfate ($BaSO_4$) particles (an average particle diameter of primary particles of 80 nm) were prepared as the inorganic particles 21 used in the core material.

200 g of untreated inorganic particles ($BaSO_4$ particles) were dispersed in 3 L of water, and thus, slurry was obtained. 208 g of sodium stannate ($Na_2SnO_3$) having a content of tin of 41 mass % was added to the slurry, and was dissolved, and thus, mixed slurry was obtained.

the mixed slurry was irradiated with an ultrasonic wave by an ultrasonic wave vibrator disposed in a part of a circulation route while being circulated. The frequency of the ultrasonic wave was set to 40 kHz, and the output was set to 570 W. A diluted sulfuric acid aqueous solution of 20 mass % was added to the circulated mixed slurry while the mixed slurry was irradiated with the ultrasonic wave, and thus, tin was neutralized. The diluted sulfuric acid aqueous solution was added for 60 minutes until pH of mixed slurry became 2.5. After the neutralization, 0.69 g of aluminum chloride hexahydrate ($AlCl_3.6H_2O$)·(a grade of 97%) was added to the mixed slurry, and the mixed slurry was stirred. Accordingly, precursor [1] of desired composite structure particles was obtained.

The precursor [1] was washed with heated water, and then, dehydration filtration was performed. A cake of the precursor [1] collected by the filtration was put into a horizontal type tube furnace, and was subjected to reduction calcining at 500° C. for 1 hour under an atmosphere of 2 volume % $H_2/N_2$. Accordingly, as illustrated in FIG. 4B, the core material (the inorganic particles) 21 described above, composite structure particles [1]25 (an average particle diameter of primary particles of 100 nm) coated with tin oxide 23 doped with aluminum (tin oxide doped with Al) were prepared. The average particle diameter of the primary particles of the composite structure particles [1]25 was measured by volume-based particle diameter measurement of particles using a laser diffraction method (the same hereinafter).

100 parts by mass of the composite structure particles [1]25, 2.5 parts by mass of a surface treatment agent: "KBM-503" (3-methacryloxypropyl triethoxy silane, which is a silane coupling agent having a methacryloyl group; manufactured by Shin-Etsu Chemical Co., Ltd.), and 1000 parts by mass of methyl ethyl ketone were put into a wet sand mill (alumina beads having a diameter of 0.5 mm), and were mixed at 30° C. for 6 hours. After that, methyl ethyl ketone and the alumina beads were filtered, and drying (powdering) was performed at 60° C., and thus, as illustrated in FIG. 4C, composite structure particles [1]25*a* were obtained in which the surface of the composite structure particles [1]25 was subjected to a surface treatment with the surface treatment agent. This is set to composite structure particles [1]25*a* subjected to the surface treatment. Furthermore, the surface of the composite structure particles [1]25 includes the surface of the inorganic particles 21 (a gap between the coating substances (the granulated substances) of tin oxide 23 doped with Al, and the like) in addition to the surface of tin oxide 23 doped with Al and coating the inorganic particles 21. It was confirmed that the surface of the composite structure particles [1]25 (the inorganic particles 21, and tin oxide 23 doped with Al and coating the inorganic particles 21) was coated with the surface treatment agent described above (the surface treated film 27 was formed) according to the surface treatment described above, by detecting a peak of Si with a fluorescence X-ray analysis device "XRF-1700 (manufactured by Shimadzu Corporation)".

97 parts by mass of the composite structure particles [1]25*a* subjected to the surface treatment and 3 parts by mass of a fluorine resin: "Novec (Registered Trademark) 2702" (manufactured by 3M Company) were mixed, and thus, as illustrated in FIG. 4D, composite structure particles [1]25*b* were obtained in which composite structure particles [1]25*a* subjected to the surface treatment (the surfaces of the inorganic particles 21 subjected to the surface treatment, tin oxide 23 doped with Al subjected to the surface treatment, and the like) were coated with the fluorine resin. This is set to composite structure particles [1]25*b* subjected to the surface treatment and the fluorine resin coating. It was confirmed that the composite structure particles [1]25*a* subjected to the surface treatment (the surfaces of the inorganic particles 21 subjected to the surface treatment, tin oxide 23 doped with Al subjected to the surface treatment, and the like) were coated with the fluorine resin described above (the fluorine resin film 29 was formed) according to the fluorine resin coating described above, by detecting a peak of a fluorine element with a fluorescence X-ray analysis device "XRF-1700 (manufactured by Shimadzu Corporation)".

In tin oxide coating the inorganic particles (the core material) of the obtained composite structure particles [1]25*b*, a doping amount of Al was 0.4 part by mass, and volume resistivity of the composite structure particles [1]25*b* subjected to the surface treatment and the fluorine resin coating was $1.0\times10^7$ Ωcm. Here, a doping amount of Al represents a ratio (parts by mass) to 100 parts by mass of tin oxide doped with Al (the same hereinafter). The doping amount of Al was measured by the ICP spectrophotometer described above (the same hereinafter). In addition, the volume resistivity was measured by using a powder compacting resistance measure system (PD-41, manufactured by Mitsubishi Chemical Corporation) and a resistivity measuring device (MCP-T600, manufactured by Mitsubishi Chemical Corporation). 15 g of a sample was put into a probe cylinder, a probe unit was set into PD-41, and a resistance value at the time of applying a pressure of 500 kgf/cm$^2$ by a hydraulic jack was measured by using MCP-T600. Powder compacting resistance (the volume resistivity) was calculated from the measured resistance value and the thickness of the sample (the same hereinafter).

[Preparation of Composite Structure Particles [2]]

Composite structure particles [2] subjected to the surface treatment and the fluorine resin coating (an average particle diameter of primary particles of 100 nm), used in Example 2, were prepared by a method similar to that in the preparation of the composite structure particles [1] except that the added amount of aluminum chloride hexahydrate ($AlCl_3.6H_2O$) was changed to 0.35 g from 0.69 g, in the preparation of the composite structure particles [1].

In tin oxide coating the inorganic particles (the core material) of the obtained composite structure particles [2], a doping amount of Al was 0.2 part by mass, and volume resistivity of the composite structure particles [2] subjected to the surface treatment and the fluorine resin coating was $1.0\times10^5$ Ωcm.

[Preparation of Composite Structure Particles [3]]

Composite structure particles [3] subjected to the surface treatment and the fluorine resin coating (an average particle diameter of primary particles of 100 nm), used in Example 3, were prepared by a method similar to that in the preparation of the composite structure particles [1] except that the added amount of aluminum chloride hexahydrate ($AlCl_3.6H_2O$) was changed to 0.17 g from 0.69 g, in the preparation of the composite structure particles [1].

In tin oxide coating the inorganic particles (the core material) of the obtained composite structure particles [3], a doping amount of Al was 0.1 part by mass, and volume resistivity of the composite structure particles [3] subjected to the surface treatment and the fluorine resin coating was $1.0\times10^4$ Ωcm.

[Preparation of Composite Structure Particles [4]]

Composite structure particles [4] subjected to the surface treatment and the fluorine resin coating (an average particle diameter of primary particles of 100 nm), used in Example 4, were prepared by a method similar to that in the preparation of the composite structure particles [1] except that the inorganic particles used in the core material were changed to silicon dioxide ($SiO_2$) particles (an average particle diameter of primary particles of 80 nm), in the preparation of the composite structure particles [1].

In tin oxide coating the inorganic particles (the core material) of the obtained composite structure particles [4], a doping amount of Al was 0.4 part by mass, and volume resistivity of the composite structure particles [4] subjected to the surface treatment and the fluorine resin coating was $1.0\times10^6$ Ωcm.

[Preparation of Composite Structure Particles [5]]

Composite structure particles [5] subjected to the surface treatment and the fluorine resin coating (an average particle diameter of primary particles of 50 nm), used in Example 5, were prepared by a method similar to that in the preparation of the composite structure particles [1] except that the inorganic particles used in the core material were changed to silicon dioxide ($SiO_2$) particles (an average particle diameter of primary particles of 30 nm), in the preparation of the composite structure particles [1].

In tin oxide coating the inorganic particles (the core material) of the obtained composite structure particles [5], a doping amount of Al was 0.4 part by mass, and volume resistivity of the composite structure particles [5] subjected to the surface treatment and the fluorine resin coating was $1.0\times10^7$ Ωcm.

[Preparation of Composite Structure Particles [6]]

Composite structure particles [6] subjected to the surface treatment and the fluorine resin coating (an average particle diameter of primary particles of 100 nm), used in Example 6, were prepared by a method similar to that in the preparation of the composite structure particles [1] except that the inorganic particles used in the core material were changed to silicon dioxide ($SiO_2$) particles (an average particle diameter of primary particles of 80 nm), and the added amount of aluminum chloride hexahydrate ($AlCl_3.6H_2O$) was changed to 0.35 g from 0.69 g, in the preparation of the composite structure particles [1].

In tin oxide coating the inorganic particles (the core material) of the obtained composite structure particles [6], a doping amount of Al was 0.2 part by mass, and volume resistivity of the composite structure particles [6] subjected to the surface treatment and the fluorine resin coating was $1.0\times10^5$ Ωcm.

[Preparation of Composite Structure Particles [7]]

Composite structure particles [7] subjected to the surface treatment and the fluorine resin coating (an average particle diameter of primary particles of 50 nm), used in Example 7, were prepared by a method similar to that in the preparation of the composite structure particles [1] except that the inorganic particles used in the core material were changed to silicon dioxide ($SiO_2$) particles (an average particle diameter of primary particles of 30 nm), and the added amount of aluminum chloride hexahydrate ($AlCl_3.6H_2O$) was changed to 0.35 g from 0.69 g, in the preparation of the composite structure particles [1].

In tin oxide coating the inorganic particles (the core material) of the obtained composite structure particles [7], a doping amount of Al was 0.2 part by mass, and volume resistivity of the composite structure particles [7] subjected to the surface treatment and the fluorine resin coating was $1.0\times10^5$ Ωcm.

[Preparation of Composite Structure Particles [8] and [9]]

Composite structure particles subjected to the surface treatment and the fluorine resin coating (an average particle diameter of primary particles of 100 nm) were prepared by a method similar to that in the preparation of the composite structure particles [1] except that the added amount of aluminum chloride hexahydrate ($AlCl_3.6H_2O$) was changed to 0.52 g from 0.69 g, in the preparation of the composite structure particles [1]. Here, the obtained composite structure particles were set to composite structure particles [8] subjected to the surface treatment and the fluorine resin coating, used in Example 8, and were set to composite structure particles [9] subjected to the surface treatment and the fluorine resin coating, used in Example 9.

In tin oxide coating the inorganic particles (the core material) of the obtained composite structure particles [8] and [9] (the same), a doping amount of Al was 0.3 part by mass, and volume resistivity of the composite structure particles [8] and [9] subjected to the surface treatment and the fluorine resin coating (the same) was $1.0\times10^6$ Ωcm.

[Preparation of Composite Structure Particles [10]]

composite structure particles [10] subjected to the surface treatment and the fluorine resin coating (an average particle diameter of primary particles of 100 nm), used in Example 10, were prepared by a method similar to that in the preparation of the composite structure particles [1] except that the inorganic particles used in the core material were changed to aluminum oxide ($Al_2O_3$) particles (an average particle diameter of primary particles of 80 nm), in the preparation of the composite structure particles [1].

In tin oxide coating the inorganic particles (the core material) of the obtained composite structure particles [10], a doping amount of Al was 0.4 part by mass, and volume resistivity of the composite structure particles [10] subjected to the surface treatment and the fluorine resin coating was $1.0\times10^7$ Ωcm.

[Preparation of Composite Structure Particles [11]]

Composite structure particles [11] subjected to the fluorine resin coating (an average particle diameter of primary particles of 100 nm), used in Example 11, were prepared by performing the fluorine resin coating according to a method similar to that in the preparation of the composite structure particles [1] without performing the surface treatment with a surface treatment agent: "KBM-503" (3-methacryloxypropyl triethoxy silane, which is a silane coupling agent having a methacryloyl group; manufactured by Shin-Etsu Chemical Co., Ltd.), in the preparation of the composite structure particles [1].

In tin oxide coating the inorganic particles (the core material) of the obtained composite structure particles [11], a doping amount of Al was 0.4 part by mass, and volume resistivity of the composite structure particles [11] subjected to the fluorine resin coating was $1.0\times10^7$ Ωcm.

[Preparation of Composite Structure Particles [12]]

Composite structure particles [12] (an average particle diameter of primary particles of 100 nm) subjected to the surface treatment, used in Example 12, were prepared according to a method similar to that in the preparation of the composite structure particles [1] without being mixed with a fluorine resin: "Novec (Registered Trademark) 2702" (manufactured by 3M Company) (without performing the fluorine resin coating), in the preparation of the composite structure particles [1].

In tin oxide coating the inorganic particles (the core material) of the obtained composite structure particles [12], a doping amount of Al was 0.4 part by mass, and volume resistivity of the composite structure particles [12] subjected to the surface treatment was $1.0\times10^7$ Ωcm.

[Preparation of Composite Structure Particles [13]]

Inorganic particles subjected to the fluorine resin coating (an average particle diameter of primary particles of 20 nm) were prepared by changing the inorganic particles to tin oxide doped with antimony (ATO transparent conductive powder T-1 series, manufactured by Mitsubishi Materials Electronic Chemicals Co., Ltd.) (Average Particle Diameter of Primary Particles: 20 nm) and by performing the fluorine resin coating with respect to the inorganic particles according to a method similar to that in the preparation of the composite structure particles [1] without performing a coating treatment and a surface treatment with tin oxide doped with Al, in the preparation of the composite structure particles [1].

The inorganic particles subjected to a fluorine treatment were directly used as composite structure particles [13] subjected to the fluorine resin coating (not having a core-shell structure) (an average particle diameter of primary particles of 20 nm), used in Comparative Example 1.

The inorganic particles of the obtained composite structure particles [13] (not having a core-shell structure) are not subjected to a coating treatment with tin oxide doped with Al, and thus, it is not possible to measure a doping amount of Al. In addition, volume resistivity of the composite structure particles [13] subjected to the fluorine resin coating (not having a core-shell structure) was $1.0\times10^4$ Ωcm.

[Preparation of Composite Structure Particles [14]]

Composite structure particles [14] subjected to the surface treatment and the fluorine resin coating (an average particle diameter of primary particles of 30 nm), used in Comparative Example 2, were prepared by a method similar to that in the preparation of the composite structure particles [1] except that the inorganic particles used in the core material were changed to barium sulfate ($BaSO_4$) particles (an average particle diameter of primary particles of 10 nm), in the preparation of the composite structure particles [1].

In tin oxide coating the inorganic particles (the core material) of the obtained composite structure particles [14], a doping amount of Al was 0.4 part by mass, and volume resistivity of the composite structure particles [14] subjected to the surface treatment and the fluorine resin coating was $1.0\times10^7$ Ωcm.

[Preparation of Composite Structure Particles [15]]

Composite structure particles [15] subjected to the surface treatment and the fluorine resin coating (an average particle diameter of primary particles of 300 nm), used in Comparative Example 3, were prepared by a method similar to that in the preparation of the composite structure particles [1] except that the inorganic particles used in the core material were changed to barium sulfate ($BaSO_4$) particles (an average particle diameter of primary particles of 280 nm), in the preparation of the composite structure particles [1].

In tin oxide coating the inorganic particles (the core material) of the obtained composite structure particles [15], a doping amount of Al was 0.4 part by mass, and volume resistivity of the composite structure particles [15] subjected to the surface treatment and the fluorine resin coating was $1.0\times10^7$ Ωcm.

[Preparation of Composite Structure Particles [16]]

Composite structure particles [16] subjected to the surface treatment and the fluorine resin coating (an average particle diameter of primary particles of 100 nm), used in Comparative Example 4, were prepared by a method similar to that in the preparation of the composite structure particles [1] except that 0.69 g of aluminum chloride hexahydrate ($AlCl_3.6H_2O$) was changed to 1.03 g of tantalum chloride ($TaCl_5$), in the preparation of the composite structure particles [1].

In tin oxide coating the inorganic particles (the core material) of the obtained composite structure particles [16], a doping amount of Ta was 0.4 part by mass, and volume resistivity of the composite structure particles [16] subjected to the surface treatment and the fluorine resin coating was $1.0\times10^6$ Ωcm.

[Preparation of Composite Structure Particles [17]]

Inorganic particles subjected to the surface treatment and the fluorine resin coating (an average particle diameter of primary particles of 100 nm) were prepared by changing the inorganic particles to barium sulfate ultrafine particles (BARIFINE (Registered Trademark) series, manufactured by SAKAI CHEMICAL INDUSTRY CO., LTD.) (Average Particle Diameter of Primary Particles: 100 nm), and by performing the surface treatment and the fluorine treatment with respect to the inorganic particles according to a method similar to that in the preparation of the composite structure particles [1] without performing the coating treatment with tin oxide doped with Al, in the preparation of the composite structure particles [1].

The inorganic particles subjected to the surface treatment and the fluorine treatment were directly used as composite structure particles [17] subjected to the surface treatment and the fluorine resin coating (not having a core-shell structure) (an average particle diameter of primary particles of 100 nm), used in Comparative Example 5.

The inorganic particles of the obtained composite structure particles [17] are not subjected to the coating treatment with tin oxide doped with Al, and thus, it is not possible to measure a doping amount of Al. In addition, volume resistivity of the composite structure particles [17] subjected to the surface treatment and the fluorine resin coating (not having a core-shell structure) was $1.0\times10^2$ Ωcm.

Example 1

[Preparation of Photoreceptor [1]]

(1) Preparation of Conductive Support Body

A surface of a drum-like aluminum support body (an outer diameter of 30 mm and a length of 360 mm) was subjected to cutting processing, and thus, a conductive support body [1] having surface roughness Rz of 1.5 (μm) was prepared.

(2) Formation of Intermediate Layer

The following raw materials were dispersed for 10 hours in a batch system by using a sand mill as a disperser, and thus, a coating liquid [1] for forming an intermediate layer was prepared.

| | |
|---|---|
| Binder Resin: Polyamide Resin "X1010" (manufactured by Daicel-Evonik Ltd.) | 1 part by mass |
| Solvent: Ethanol | 20 parts by mass |
| Metal Oxide Fine Particles: Titanium Oxide Fine Particles "SMT500SAS" of Number Average Primary Particle Diameter of 0.035 μm (manufactured by TAYCA CORPORATION) | 1.1 parts by mass |

The coating liquid [1] for forming an intermediate layer was applied onto the conductive support body [1] described above by an immersion coating method, and thus, a coating film was formed, and the coating film was dried at 110° C. for 20 minutes, and thus, an intermediate layer [1] having a layer thickness of 2 μm was formed.

(3) Formation of Electric Charge Generating Layer

The following raw materials were dispersed for 10 hours by using a sand mill as a disperser, and thus, a coating liquid [1] for forming an electric charge generating layer was prepared.

| | |
|---|---|
| Electric Charge Generating Substance: Titanyl Phthalocyanine Pigment (in Cu-Kα characteristic X-ray diffraction spectrum measurement, a maximum diffraction peak is obtained at least in a position of 27.3°) | 20 parts by mass |

-continued

| | |
|---|---|
| Binder Resin: Polyvinyl Butyral Resin "#6000-C" (manufactured by Denka Company Limited) | 10 parts by mass |
| Solvent: t-Butyl Acetate | 700 parts by mass |
| Solvent: 4-Methoxy-4-Methyl-2-Pentanone | 300 parts by mass |

The coating liquid [1] for forming an electric charge generating layer was applied onto the intermediate layer [1] described above by using an immersion coating method, and thus, a coating film was formed, and an electric charge generating layer [1] having a layer thickness of 0.3 μm was formed.

(4) Formation of Electric Charge Transport Layer

The following raw materials were mixed and dissolved, and thus, a coating liquid [1] for forming an electric charge transport layer was prepared.

| | |
|---|---|
| Electric Charge Transport Substance: Compound represented by Formula (A) described below | 150 parts by mass |
| Binder Resin: Polycarbonate Resin "Z300" (manufactured by MITSUBISHI GAS CHEMICAL COMPANY, INC.) | 300 parts by mass |
| Solvent: Toluene/Tetrahydrofuran = 1/9 volume % | 2000 parts by mass |
| Antioxidation Agent: "Irganox1010" (manufactured by BASF SE) | 6 parts by mass |
| Leveling Agent: Silicone Oil "KF-54" (manufactured by Shin-Etsu Chemical Co., Ltd.) | 1 part by mass |

The coating liquid [1] for forming an electric charge transport layer was applied onto the electric charge generating layer [1] described above by using an immersion coating method, and thus, a coating film was formed, and the coating film was dried at 120° C. for 70 minutes, and thus, an electric charge transport layer [1] having a layer thickness of 20 μm was formed.

[Chemical Formula 7]

Formula (A)

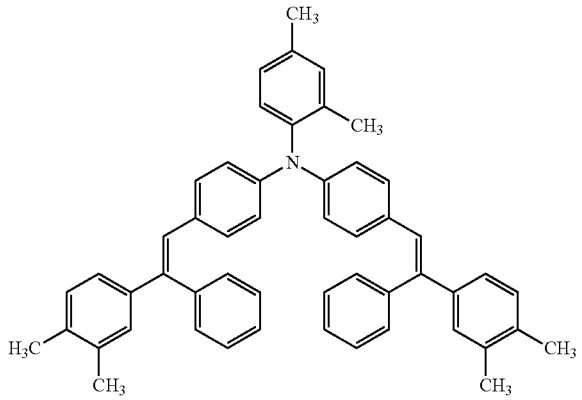

(5) Formation of Outermost Surface Layer

| | |
|---|---|
| Composite Structure Particles [1] Obtained in Preparation of Composite Structure Particles [1] | 100 parts by mass |
| Multifunctional Radical Polymerizable Compound: Trimethylol Propane Trimethacrylate (manufactured by Arkema Inc.) | 100 parts by mass |

-continued

| | |
|---|---|
| Solvent: 2-Butanol | 400 parts by mass |
| Solvent: THF (Tetrahydrofuran) | 40 parts by mass |
| were mixed under a light-shielded condition, and were dispersed for 5 hours by using a sand mill as a disperser, and then, | |
| Polymerization Initiator: Irgacure 819 (manufactured by BASF SE) | 10 parts by mass |

was added thereto, and stirring and dissolving were performed under a light-shielded condition, and thus, a coating liquid [1] for forming an outermost surface layer was prepared.

The coating liquid [1] for forming an outermost surface layer was applied onto the electric charge transport layer [1] by using a circular slide hopper coating device, and thus, a coated film was formed and was irradiated with an ultraviolet ray for 1 minute by using a metal halide lamp, and thus, an outermost surface layer [1] having a dry film thickness of 3.0 μm was formed, and a photoreceptor [1] was completed.

Examples 2 to 12 and Comparative Examples 1 to 5

[Preparation of Photoreceptors [2] to [17]]

Photoreceptors [2] to [17] were prepared by a method similar to that in the preparation of the photoreceptor [1] except that the composite structure particles [1] obtained in the preparation of the composite structure particles [1] described above were changed to the composite structure particles [2] to [17] prepared in the preparation of the composite structure particles [2] described above and the preparation of the composite structure particles [17], and were changed to have the formulation (the number of parts (the used amount) of the composite structure particles) in Table 1, in the formation (step) of the outermost surface layer in the preparation of the photoreceptor [1].

The configurations of the photoreceptors [1] to [17] prepared in Examples 2 to 12 and Comparative Examples 1 to 5 are shown in Table 1 described below.

(Evaluation)

(1) Abrasion Properties

Abrasion properties were evaluated by a depletion amount in a film thickness of the outermost surface layer of the photoreceptor before and after capturing 30,000 photographs in a black toner (Bk) position according to the following evaluation standard under a condition of a room temperature of 23° C. and humidity of 50% RH, by using bizhub (Registered Trademark) 554, manufactured by KONICA MINOLTA, INC. Evaluation results of the photoreceptors [1] to [17] are shown in Table 1.

Specifically, in a film thickness of the outermost surface layer of the photoreceptor, ten homogeneous film thickness portions (excluding film thickness variation portions of a front end portion and a rear end portion of coating by preparing a film thickness profile) are randomly measured, and the average value thereof is set to the film thickness of the outermost surface layer. A film thickness measuring device "EDDY560C" (manufactured by Helmut Fischer Gmbte) of an eddy current system was used as a film thickness measuring device, a difference in the film thickness of the outermost surface layer before and after an endurance test (30,000 photographs) was calculated as the depletion amount in the film thickness (μm). In the endurance test, a test was performed in which a character image of an image ratio of 5% was subjected to A4 transverse conveyance in the Bk position under a condition of a room temperature of 23° C. and humidity of 50% RH, and printing (photographing) was continuously performed with respect to 30,000 single-surfaces.

—Evaluation Standard of Abrasion Properties (Depletion Amount in Film Thickness)—

⊙: Abrasion in which the depletion amount in the film thickness is less than 0.3 μm (extremely excellent)

○: Abrasion in which the depletion amount in the film thickness is greater than or equal to 0.3 μm and less than 0.6 μm (excellent)

Δ: Abrasion in which the depletion amount in the film thickness is greater than or equal to 0.6 μm and less than 1 μm (not having a practical problem)

x: Abrasion in which the depletion amount in the film thickness is greater than or equal to 1 μm (having a practical problem).

(2) Electric Characteristics

A surface electric potential after exposure was measured by setting an initial electric potential to 600±30 V, and evaluation was performed according to the following evaluation standard, under a condition of a room temperature of 23° C. and humidity of 50% RH, by using bizhub (Registered Trademark) 368 manufactured by KONICA MINOLTA, INC. Evaluation results of the photoreceptors [1] to [17] are shown in Table 1.

—Evaluation Standard of Electric Characteristics (Surface Electric Potential after Exposure)—

⊙: The surface electric potential after exposure is less than 60 V (extremely excellent)

○: The surface electric potential after exposure greater than or equal to 60 V and less than 90 V (excellent)

Δ: The surface electric potential after exposure greater than or equal to 90 V and less than 120 V (not having a practical problem)

x: The surface electric potential after exposure greater than or equal to 120 V (having a practical problem).

(3) Fine Line Properties

One sheet of a black line (one dot) in a black toner (Bk) position (an evaluation chart is a lattice-like evaluation chart of one dot, and a horizontal line of the lattice is evaluated) was output, the formed black line was observed with an optical microscope, and evaluation was performed according to the following evaluation standard, under a condition of a room temperature of 30° C. and humidity of 80% RH (a high humidity environment), by using bizhub (Registered Trademark) C368 manufactured by KONICA MINOLTA, INC. Evaluation results of the photoreceptors [1] to [17] are shown in Table 1.

—Evaluation Standard of Fine Line Properties (Observation of Black Line with Optical Microscope)—

⊙: The black line is formed with a constant line width without being cut (extremely excellent)

○: A part of the line width of the black line is disordered but is not cut (excellent)

Δ: A part of the black line is cut (not having a practical problem)

x: The black line is not formed (having a practical problem).

TABLE 1

| Example | | Composite Structure Particles | | | | | | |
|---|---|---|---|---|---|---|---|---|
| | | Core (Inorganic Particles) | | Shell | | | Surface Treatment Agent Having Polymerizable Reactive Group | |
| Comparative Example No. | Photoreceptor No. | Type | Average Particle Diameter of Primary Particles [nm] | Doping Type | Doping Amount [Parts by Mass] | Volume Resistivity [Ωcm] | Treatment Type | Treatment Amount [Parts by Mass] |
| Example 1 | 1 | BaSO4 | 80 | Al | 0.4 | 1.0E+07 | KBM503 | 2.5 |
| Example 2 | 2 | BaSO4 | 80 | Al | 0.2 | 1.0E+05 | KBM503 | 5 |
| Example 3 | 3 | BaSO4 | 80 | Al | 0.1 | 1.0E+04 | KBM503 | 2.5 |
| Example 4 | 4 | SiO2 | 80 | Al | 0.4 | 1.0E+06 | KBM503 | 7.5 |
| Example 5 | 5 | SiO2 | 30 | Al | 0.4 | 1.0E+07 | KBM503 | 5 |
| Example 6 | 6 | SiO2 | 80 | Al | 0.2 | 1.0E+05 | KBM503 | 2.5 |
| Example 7 | 7 | SiO2 | 30 | Al | 0.2 | 1.0E+05 | KBM503 | 2.5 |
| Example 8 | 8 | BaSO4 | 80 | Al | 0.3 | 1.0E+06 | KBM503 | 5 |
| Example 9 | 9 | BaSO4 | 80 | Al | 0.3 | 1.0E+06 | KBM503 | 1 |
| Example 10 | 10 | Al2O3 | 80 | Al | 0.4 | 1.0E+07 | KBM503 | 2.5 |
| Example 11 | 11 | BaSO4 | 80 | Al | 0.4 | 1.0E+07 | — | — |
| Example 12 | 12 | BaSO4 | 80 | Al | 0.4 | 1.0E+07 | KBM503 | 2.5 |
| Comparative Example 1 | 13 | SnO2 (Doped with Sb) | 20 | — | — | 1.0E+04 | — | — |
| Comparative Example 2 | 14 | BaSO4 | 10 | Al | 0.4 | 1.0E+07 | KBM503 | 2.5 |
| Comparative Example 3 | 15 | BaSO4 | 280 | Al | 0.4 | 1.0E+07 | KBM503 | 2.5 |
| Comparative Example 4 | 16 | BaSO4 | 80 | Ta | 0.4 | 1.0E+06 | KBM503 | 2.5 |
| Comparative Example 5 | 17 | BaSO4 | 100 | — | — | 1.0E+02 | KBM503 | 2.5 |

TABLE 1-continued

| Example | Composite Structure Particles Fluorine Treatment Agent | | Average Particle Diameter of Primary Particles of Composite Structure Particles [nm] | Content of Composite Structure Particles [Parts by Mass] | Evaluation Item | | |
|---|---|---|---|---|---|---|---|
| Comparative Example No. | Type | Treatment Amount [Parts by Mass] | | | Abrasion Properties | Electric Characteristics | Fine Line Properties |
| Example 1 | Novec2702 | 3 | 100 | 100 | ⊙ | Δ | ⊙ |
| Example 2 | Novec2702 | 3 | 100 | 100 | ⊙ | ○ | ○ |
| Example 3 | Novec2702 | 3 | 100 | 100 | ⊙ | ⊙ | Δ |
| Example 4 | Novec2702 | 3 | 100 | 100 | ⊙ | Δ | ⊙ |
| Example 5 | Novec2702 | 3 | 50 | 100 | ⊙ | Δ | ○ |
| Example 6 | Novec2702 | 3 | 100 | 100 | ⊙ | ○ | Δ |
| Example 7 | Novec2702 | 3 | 50 | 100 | ⊙ | ○ | Δ |
| Example 8 | Novec2702 | 3 | 100 | 70 | ○ | Δ | ⊙ |
| Example 9 | Novec2702 | 3 | 100 | 200 | ○ | ⊙ | Δ |
| Example 10 | Novec2702 | 3 | 100 | 100 | ⊙ | Δ | ⊙ |
| Example 11 | Novec2702 | 3 | 100 | 100 | Δ | ○ | ○ |
| Example 12 | — | — | 100 | 100 | Δ | ⊙ | Δ |
| Comparative Example 1 | Novec2702 | 3 | 20 | 100 | X | ○ | X |
| Comparative Example 2 | Novec2702 | 3 | 30 | 100 | X | X | ○ |
| Comparative Example 3 | Novec2702 | 3 | 300 | 100 | X | ⊙ | X |
| Comparative Example 4 | Novec2702 | 3 | 100 | 100 | ○ | X | X |
| Comparative Example 5 | Novec2702 | 3 | 100 | 100 | Δ | ○ | X |

From the results of Table 1, in the photoreceptors [1] to [12] of Examples 1 to 12, in which the outermost surface layer of the photoreceptor contains the composite structure particles and the resin binder, and in the composite structure particles described above, the core material is the inorganic particles, the inorganic particles are coated with tin oxide doped with aluminum (Al), and the average particle diameter of the primary particles of the composite structure particles is 50 nm to 200 nm, excellent evaluation is obtained in each evaluation item.

In contrast, in the photoreceptors [13] to [17] in Comparative Examples 1 to 5, at least one of the requirements that the outermost surface layer of the photoreceptor contains the composite structure particles and the resin binder, in the composite structure particles described above, the core material is the inorganic particles, the inorganic particles are coated with tin oxide doped with aluminum (Al), and the average particle diameter of the primary particles of the composite structure particles is 50 nm to 200 nm, is not satisfied, and thus, a problem occurs in at least one of the abrasion properties, the electric characteristics, and the fine line properties.

Although embodiments of the present invention have been described and illustrated in detail, it is clearly understood that the same is by way of illustration and example only and not limitation, the scope of the present invention should be interpreted by terms of the appended claims.

What is claimed is:

1. An electrophotographic photoreceptor in which an electric charge generating layer and an electric charge transport layer are laminated on a conductive support body in this order, wherein a layer configuring an outermost surface of the electrophotographic photoreceptor contains composite structure particles in which a core material is inorganic particles, the inorganic particles are coated with tin oxide doped with aluminum, and the composite structure particles are coated with a fluorine resin, and an average particle diameter of primary particles of the composite structure particles is 50 nm to 200 nm.

2. The electrophotographic photoreceptor according to claim 1, wherein the inorganic particles are any one of $BaSO_4$, $SiO_2$, or $Al_2O_3$.

3. The electrophotographic photoreceptor according to claim 1, wherein in tin oxide doped with aluminum, which coats the inorganic particles, a doping amount of Al with respect to 100 parts by mass of tin oxide is in a range of 0.05 part by mass to 1 part by mass, and volume resistivity of the composite structure particles is $10^1$ Ωcm to $10^2$ Ωcm.

4. The electrophotographic photoreceptor according to claim 1, wherein the composite structure particles are subjected to a surface treatment with a surface treatment agent Having a polymerizable reactive group in a range of 0.5 part by mass to 10 parts by mass with respect to 100 parts by mass of the composite structure particles, which are not subjected to the surface treatment, and the surface treatment agent is a silane coupling agent containing an acryloyl group or a methacryloyl group.

5. The electrophotographic photoreceptor according to claim 1, wherein the composite structure particles are coated with the fluorine resin in a range of 1 part by mass to 10 parts by mass with respect to 100 parts by mass of the composite structure particles.

6. The electrophotographic photoreceptor according to claim 1, wherein the layer configuring the outermost surface of the electrophotographic photoreceptor further contains a resin binder, and a content of the composite structure particles is in a range of 50 parts by mass to 250 parts by mass with respect to 100 parts by mass of the resin binder.

7. The electrophotographic photoreceptor according to claim 6, wherein the resin binder is a polymerized cured substance of a polymerizable compound.

8. An image forming apparatus, comprising:

the electrophotographic photoreceptor according to claim 1;

a charger for charging a surface of the electrophotographic photoreceptor;

an exposurer for forming an electrostatic latent image by irradiating the charged surface of the electrophotographic photoreceptor with light;

a developer for forming a toner image by supplying a toner to the electrophotographic photoreceptor on which the electrostatic latent image is formed; and a transferee for transferring the toner image on the surface of the electrophotographic photoreceptor to a recording medium, wherein the charger is a charger of a proximity charging system for applying a charging voltage in proximity to the surface of the electrophotographic photoreceptor.

9. The electrophotographic photoreceptor according to claim 1, wherein the composite structure particles are coated with the fluorine resin in a range of 0.1 part by mass to 100 parts by mass with respect to 100 parts by mass of the composite structure particles.

* * * * *